US006171160B1

(12) United States Patent
Skaggs et al.

(10) Patent No.: US 6,171,160 B1
(45) Date of Patent: Jan. 9, 2001

(54) FLOATING DEVICES CONNECTION AND/ OR STORAGE SYSTEM AND TABLE

(76) Inventors: Shelley S. Skaggs; Barry Skaggs, both of 3320 Sunrise Dr., LaPorte, TX (US) 77571

( * ) Notice: Under 35 U.S.C. 154(b), the term of this patent shall be extended for 0 days.

(21) Appl. No.: 09/258,351

(22) Filed: Feb. 26, 1999

(51) Int. Cl.[7] ..... B63B 35/73
(52) U.S. Cl. ..... 441/129; 441/136
(58) Field of Search ..... 441/128, 129, 441/35, 136; 114/190, 188, 264; 472/129, 128

(56) References Cited

U.S. PATENT DOCUMENTS

| | | | | |
|---|---|---|---|---|
| 19,593 | | 3/1858 | Urquhart . | |
| 30,794 | | 12/1860 | Bauhoefer . | |
| 67,039 | | 7/1867 | Golding . | |
| 136,749 | | 3/1873 | Mountain . | |
| 496,696 | | 5/1893 | Nash . | |
| 2,815,909 | | 12/1957 | Paprocki . | |
| 3,332,094 | * | 7/1967 | Vorenkamp | 441/35 |
| 3,675,257 | * | 7/1972 | Haglund et al. | 114/190 |
| 3,694,837 | * | 10/1972 | Von Norring | 114/264 |
| 3,833,159 | | 9/1974 | Ono . | |
| 4,221,024 | | 9/1980 | Becker . | |
| 4,894,033 | | 1/1990 | Chang . | |
| 5,018,723 | | 5/1991 | Burdenko . | |
| 5,176,554 | | 1/1993 | Simmons . | |
| 5,345,656 | | 9/1994 | Merritt . | |
| 5,411,425 | | 5/1995 | Rinker . | |
| 5,460,113 | * | 10/1995 | Gunter | 441/129 |
| 5,514,057 | | 5/1996 | Ciolinop . | |
| 5,560,056 | * | 10/1996 | Tai | 441/129 |
| 5,810,632 | * | 9/1998 | Huston, III | 441/129 |
| 5,823,121 | * | 10/1998 | Reiter | 108/147.19 |

FOREIGN PATENT DOCUMENTS

| | | | | |
|---|---|---|---|---|
| 75920 | * | 3/1919 | (DE) | 441/35 |
| 452784 | | 5/1913 | (FR) . | |
| 569623 | * | 4/1924 | (FR) | 441/128 |
| 1439 | | of 1860 | (GB) . | |
| 21294 | | of 1912 | (GB) . | |
| 28695 | | of 1915 | (GB) . | |

OTHER PUBLICATIONS

Undated Flyer: Floaters, 3 sheets, Macho Products, Inc., Sebastian, Florida.

* cited by examiner

*Primary Examiner*—Sherman Basinger
(74) *Attorney, Agent, or Firm*—Piper, Marbury, Rudnick & Wolfe, L.L.P.; Wilburn L. Chesser, Esq.

(57) ABSTRACT

A floating devices connection and/or storage system, including a wide variety of hermaphroditic and non-hermaphroditic connectors for interconnecting two or more floating devices together. The connectors may be original equipment or added as after-market items. Storage devices include structure for storing floating devices from a vertical surface, spaced therefrom to guard against mold and mildew formation on the floating devices by assuring air flow about the stored device. A floating table, which is also disclosed, has a unitary structure and is useful in water or on land, having a weighted base and water-draining top surface, the water-draining top surface being slightly convex in structure. Further disclosed is a floating water lounge, the lounge including a floating wedge portion and being anchorable to prevent drift.

28 Claims, 30 Drawing Sheets

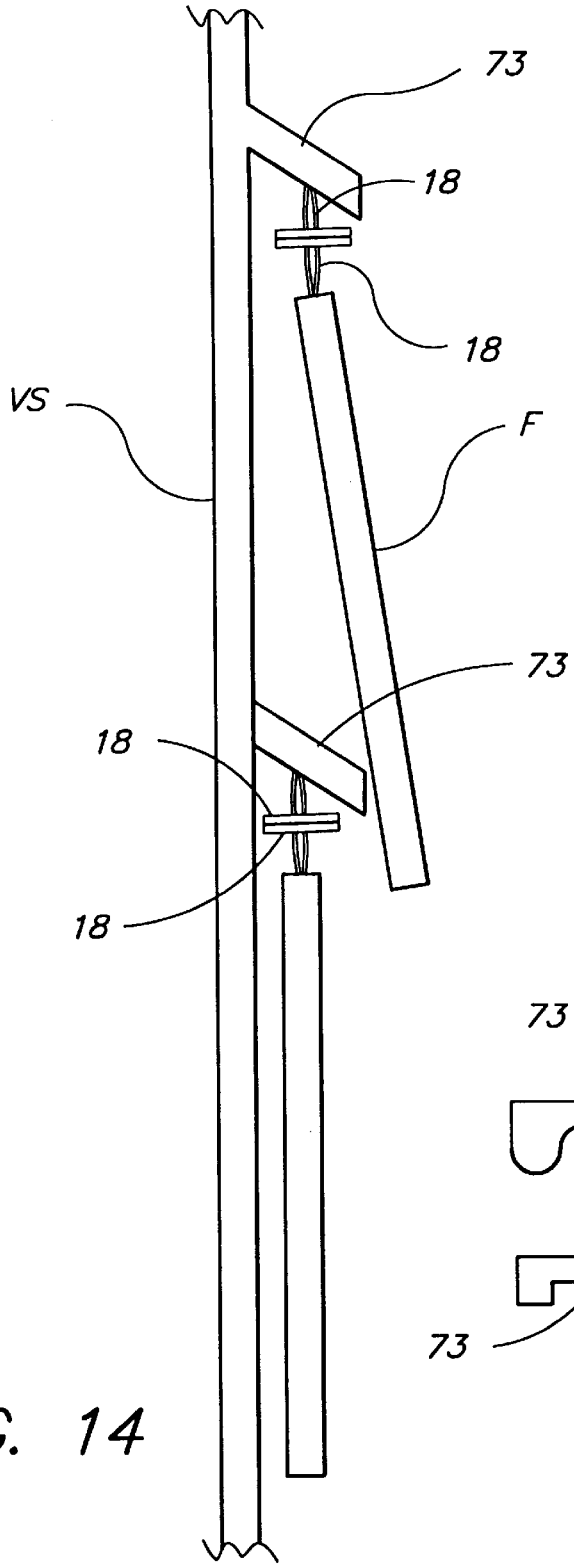
FIG. 14
FIG. 14A
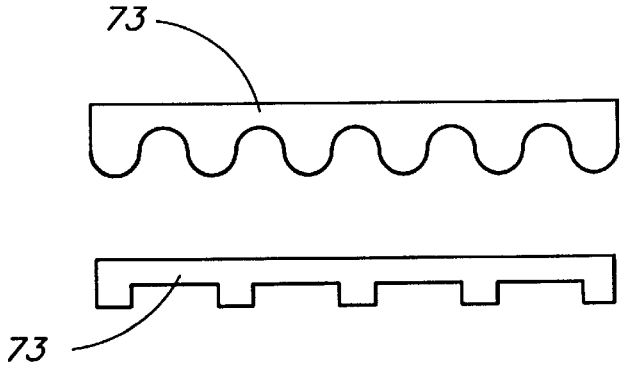
FIG. 14B

FLOATING DEVICES CONNECTION AND/ OR STORAGE SYSTEM AND TABLE

BACKGROUND OF THE INVENTION

1. Field of the Invention

The present invention relates to: floating devices in general, and more particularly to a floating devices connection and interconnection system, as both aftermarket and original manufacture systems; methods and structure for storage of floating devices; and novel floatation devices, e.g., an attractive floating table which is weight-stabilized from beneath for water use and also useful at poolside without modification from pool use.

2. Description of the Related Art

Water toys at poolside, at the beach and elsewhere are increasing both in variety and number. Rafts, balls, floating lounges, and a wide variety of other creature-comfort devices abound. Often, it is desirable to connect one or more of similar or disparate devices together to enhance the utility of the devices and pleasure in their use. The prior art simply does not show or describe the variety and simplicity and utility of various connection and interconnection devices of the instant invention.

Furthermore, many water toy items are easily soiled, particularly by mildew and other wet loving plant and animal life which tend to grow on the items when stored, due to lack of proper air circulation about the items when stored. The present invention provides uncomplicated, easily-used storage structures and keepers which not only allow the items to be stored easily and neatly, but also assure adequate air circulation about the item when it is stored, so that it may dry and not accumulate and/or encourage the growth of mildew, etc. Connectors used to secure items together when in use may also be used for storage of the items, or alternatively, special, attractive, but uncomplicated storage racks may be employed to store items without fear of mildew or dry rot occurring.

Additionally, it has been found, particularly in a pool environment, that a floating but stable table structure is most desirable. The present invention encompasses such a table, so sturdy even when floating that it will support a drink without spillage. A primary feature of this novel floating table is that a stabilizing weight is suspended beneath the table when in use. If desired, the floating table may include connectors of any type, including those further disclosed hereinbelow, for connecting the table to other items, e.g., a floating lounge chair so that the table does not drift apart from the chair. Furthermore, the table is both attractive and uncomplicated in structure, so as to be useful out of the water, e.g., at poolside, without structural modification of any sort; the table is simply lifted out of the water and placed at poolside.

The related art, while of interest per the discussion which follows, simply does not disclose or suggest the essential features of the instant invention as just recounted.

The related art is discussed as it is relevant to features of the instant invention.

U.S. Pat. No. 19,593 issued Mar. 9, 1858, to W. Urquhart shows life preserving mattresses tied together by belt-and-buckle strapping to form a raft; this is also seen at least at the end of a mattress in the Great Britain Patent No. 28,695 of 1915. A similar teaching employing snap hooks and eyes is seen in U.S. Pat. No. 67,039 issued Jul. 23, 1867, to John Golding, while yet another disclosure of a similar raft with mattress elements connected by ring and snap hook connectors is seen in the French Patent to Caverley, No. 452.784 published May 23, 1913. A further variation on this last-mentioned theme, employing hermaphroditic, double snap hook and ring connectors to multiple mattresses to form a raft, is taught in Great Britain Patent No. 21,294 of 1912.

Two mattresses interconnected by a sack-like structure to form a floating raft are disclosed in U.S. Pat. No. 136,749 issued Mar. 11, 1873 to Hannah B. Mountain, while U.S. Pat. No. 30,794 issued Dec. 4, 1860 to Louis Bauhoefer teaches a life preserving mattress with cork floats tied to a mattress made up of a rigid frame filled with cork shavings, for example. (There is a Great Britain equivalent, No. 1439 of 1860.) This rather ancient art is discussed only for the very general teaching of a float of some sort made of multiple mattresses tied together.

More recent developments include U.S. Pat. No. 4,894, 033 issued to Harry Chang on Jan. 16, 1990, teaching a structure including several inflatable rafts connected together by "T" and ring or loop interconnector devices. A floating chair made up of individual rigid sections but having flexible straps permanently interconnecting the sections is seen in U.S. Pat. No. 5,176,554 issued to Thomas R. Simmons on Jan. 5, 1993. Another floating structure generally including a pair of floating pillows interconnected by a seat, connections being made only at the four corners of the pillows and seat, one pillow and both pillows without the seat being useful, and the device further having utility as a watercraft float is taught by U.S. Pat. No. 5,411, 425 issued to David E. Rinker on May 2, 1995. A floatation platform for exercising and including well-known bayonet-and sheath type connectors for attaching stretching rings to the platform is seen in U.S. Pat. No. 5,514,057 issued to Peter A. Ciolino on May 7, 1996. An exercise device adapted for pool use, and made up of tracks suspended below water level and interconnected by hooks and loops is taught in U.S. Pat. No. 5,018,723 issued to Igor Burdenko on May 28, 1991.

There are a plethora of hooks and suspending devices taught in the related art, of course, but these are not configured and styled for the particular uses of the instant invention, as will become fully evident hereinbelow. For example, U.S. Pat. No. 496,696 issued to Arthur C. Nash on May 2, 1893, shows a trousers hanger made of a length of line, two end hooks, and sliding rings to tighten up the doubled line end adjacent one hook. Locks or keepers that slide along a cord or pair of cords are taught in U.S. Pat. Nos.: 2,815,909 issued to Cora S. Paprocki et al on Dec. 10, 1957, a nursing bottle holder; 3,833,159 issued to Iwao Ono on Sep. 3, 1974, a hosiery hanger; 4,221,024 issued to Harvey W. Becker on Sep. 9, 1980, a ski storage device; and 5,345,656 issued to Richard C. Merritt on Sep. 13, 1994, a cord lock. A far less complicated and useful slide lock is a somewhat semi-rigid cord keeper or lock which is part of a floating tether cord marketed by JetPet, Inc. I have found this keeper to be useful in certain embodiments of my invention, as will be explained in detail below. Items very recently marketed as "Floaters" by Macho Products, Inc., (undated fliers, three pages) include head rests, spa pillows, pool accessories and pool chairs with one or more peripheral hooks for connecting items together, similar to the non-hermaphroditic methods shown in the related art. The hermaphroditic connectors of the instant invention are not a part of the product line and the hanging arrangements and float structure of the instant invention are not apparent from these product fliers. Similarly, after-market connectors are not taught by the Macho Product fliers.

The floating table of my invention includes an integral weighted base and the table is of unitary construction so as to be useful in water, e.g., a pool, or on a stable surface, e.g., the poolside, without need of modifying or changing the table in any way for use conversion. The table may include one or more connectors for attachment of the table to a float, floating lounge chair, etc., to keep the table handy, so it does not float away. The related art is silent as to this particular table and/or table with connectors of my invention.

None of the above inventions and patents, taken either singularly or in combination, is seen to describe the instant invention as claimed. Thus a floating devices connection and/or storage system solving the aforementioned problems is desired.

SUMMARY OF THE INVENTION

The invention is made up of floating devices connection and interconnection systems, as both aftermarket and original manufacture systems, such that floats of similar or different sizes, in pairs or more, may be readily connected and disconnected from each other, preferably with the use of hermaphroditic connection devices, thus eliminating the nuisance of trying to align male with female connectors, a distinct disadvantage of prior art devices and systems. The connectors in preferred embodiments also include slide keepers or locks which serve to assure that, once two or more items are connected, they will stay connected, and yet the keepers or locks may be very readily moved so that the connectors come apart, all without the need of any tools whatsoever, of course.

Also, the invention encompasses methods and structure fox storage of floating devices, which are easily made and used, and suspend the floating devices, e.g., rafts, floats, both non-inflatable and inflatable by way of example, with the suspended device spaced away from a vertical surface; this greatly reduces if not eliminates the possibility of mildew and mold from forming on the device being stored and dried, and this is a real problem solved, particularly in hot, humid areas of the country. The spacing function may be accomplished by structure as uncomplicated as a pair of vertically arrayed 2×4's with suspension connections thereon for the device being stored and dried, or a doubled loop and hook suspension assembly, including a depending spacer to assure the device is kept away from a vertical surface where the device is stored for drying. The structure for storing may be attached to a wall, or it could be free standing, supported by a pedestal base or bases, and might even include dolly wheels for ease of moving the storage structure from place to place.

Furthermore, the invention encompasses an attractive floating table which is weight-stabilized from beneath for water use and also useful at poolside without modification from pool use. In a preferred embodiment, the table is of unitary construction, molded from a plastics material and having a weight enclosed in its base. The table will be weight-engineered to assure that it has positive buoyancy. This may include provision of a buoyant material in the construction of the table. Furthermore, the table top may include structure to assure water does not remain on its upper surface Such structure might be simply making the table top gently upwardly convex, for example. In another embodiment, the table would be useful in water only, essentially, and include a flat, upper table with a strategically placed weight suspended from beneath the table. In both table embodiments, the structure is sufficiently stable to support drinks, food, and other items with surprising ease, and without toppling of items supported on the table when the table is in water.

Accordingly, it is a principal object of the invention to provide a floating devices connection and/or storage system, as original or after-market equipment.

It is another object of the invention to provide a floating devices connection and/or storage system including hermaphroditic interconnectors.

It is a further object of the invention to provide a floating devices connection and/or storage system utilizing connectors for interconnecting two or more devices together and employing the same connectors for suspending the devices, for drying and storage.

Still another object of the invention is to provide a floating devices connection and/or storage system including a floating raft construction made up of two panels sandwiching a web or framework lattice therebetween, with a plurality of connection devices extended from sides and ends of the finished product; reinforcements may also be provided at the junction of raft side and connector.

Yet an additional object of the invention is to provide a weight-stabilized floating table structure which, in a preferred embodiment, may also be used as a table out of water, without need of any modification of the table between uses.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 14 is a side elevational view of yet another storage system of the invention, and FIGS. 14A and 14B are detail views of alternate spacers used in this embodiment of the invention.

FIG. 18 is an elevational, perspective view of another storage system, similar to that shown in FIG. 10.

Similar reference characters denote corresponding features consistently throughout the attached drawings.

DETAILED DESCRIPTION OF THE PREFERRED EMBODIMENTS

The present invention is a complete floating devices and water toys interconnection system for poolside or other waterside (e.g., lake, bay, ocean) use, and including various storage configurations, with locks of uncomplicated construction so as to assure that connectors, once connected, will stay connected. The connectors and storage systems of the instant invention further include various float or pad constructions and a floating table that may be used with the connection systems of the invention.

Figure 1:
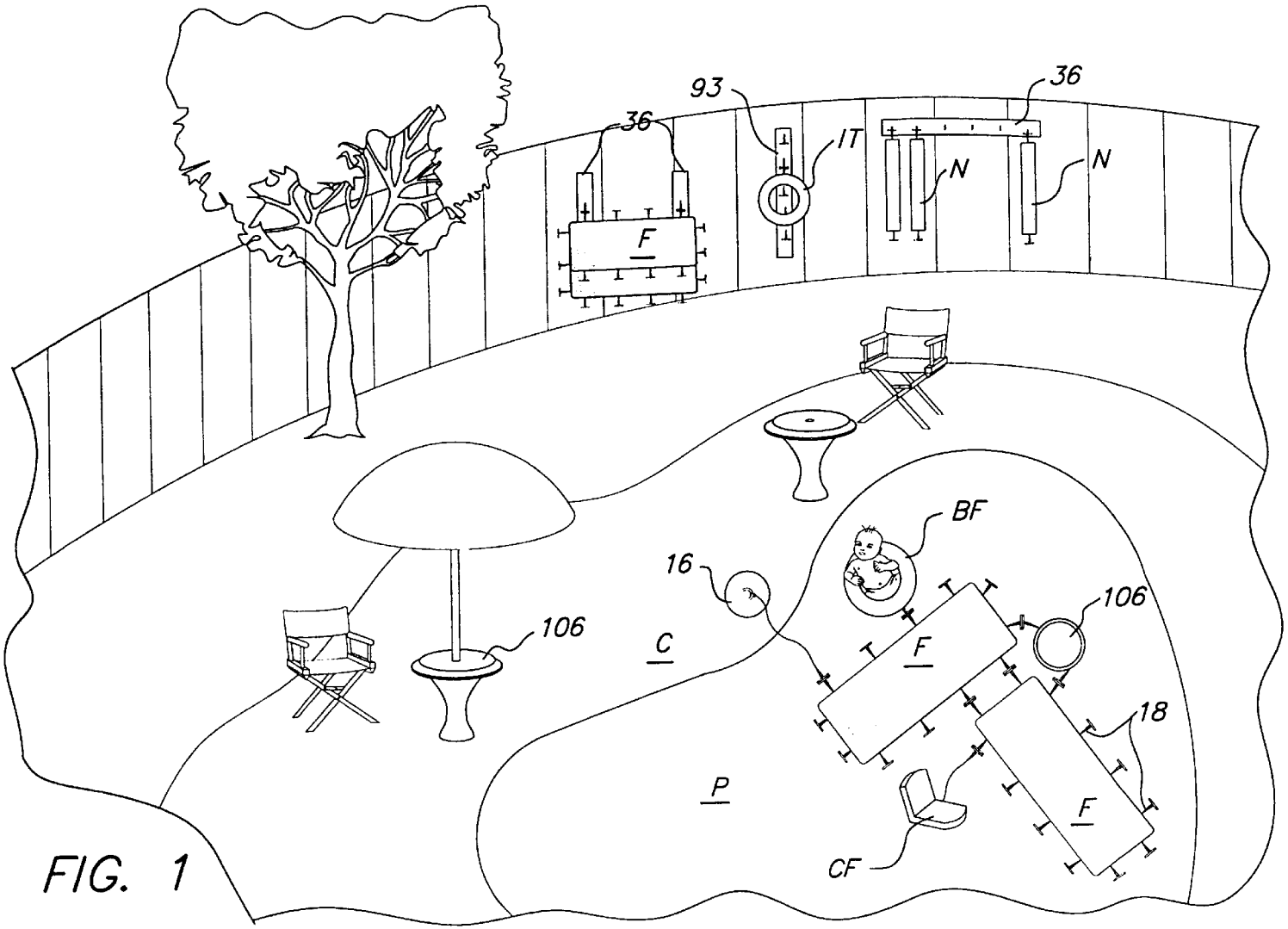
FIG. 1 is a perspective view of a pool area depicting several components of the invention in use.

Turning now to FIG. 1, a first embodiment of a float and connection system according to the teachings of the present invention is shown, in a pool environment. This view is diagrammatical in nature, showing a number of different connectors for a float F and a lounge float LF, for example, stabilizing the floats F and LF in the pool P. Obviously, not all of the connectors would be used at the same time.

Additionally and more specifically, FIG. 1 shows a baby float BF, a chair float CF and a floating table 106 (described in greater detail below), all interconnected together by connectors 18, and stabilized by an anchor weight 16 situated on the coping C of the pool P. This view also shows tables at poolside and storage racks at the rear for hanging and drying a variety of items, such as floats F, inner tubes IT and noodles N, just to name a few. Now, clearly this view merely shows a representative sample of the great versatility of the connection and storage system of the present invention, and in no way should be intended to limit the broad scope of the invention in any way.

Figure 2:
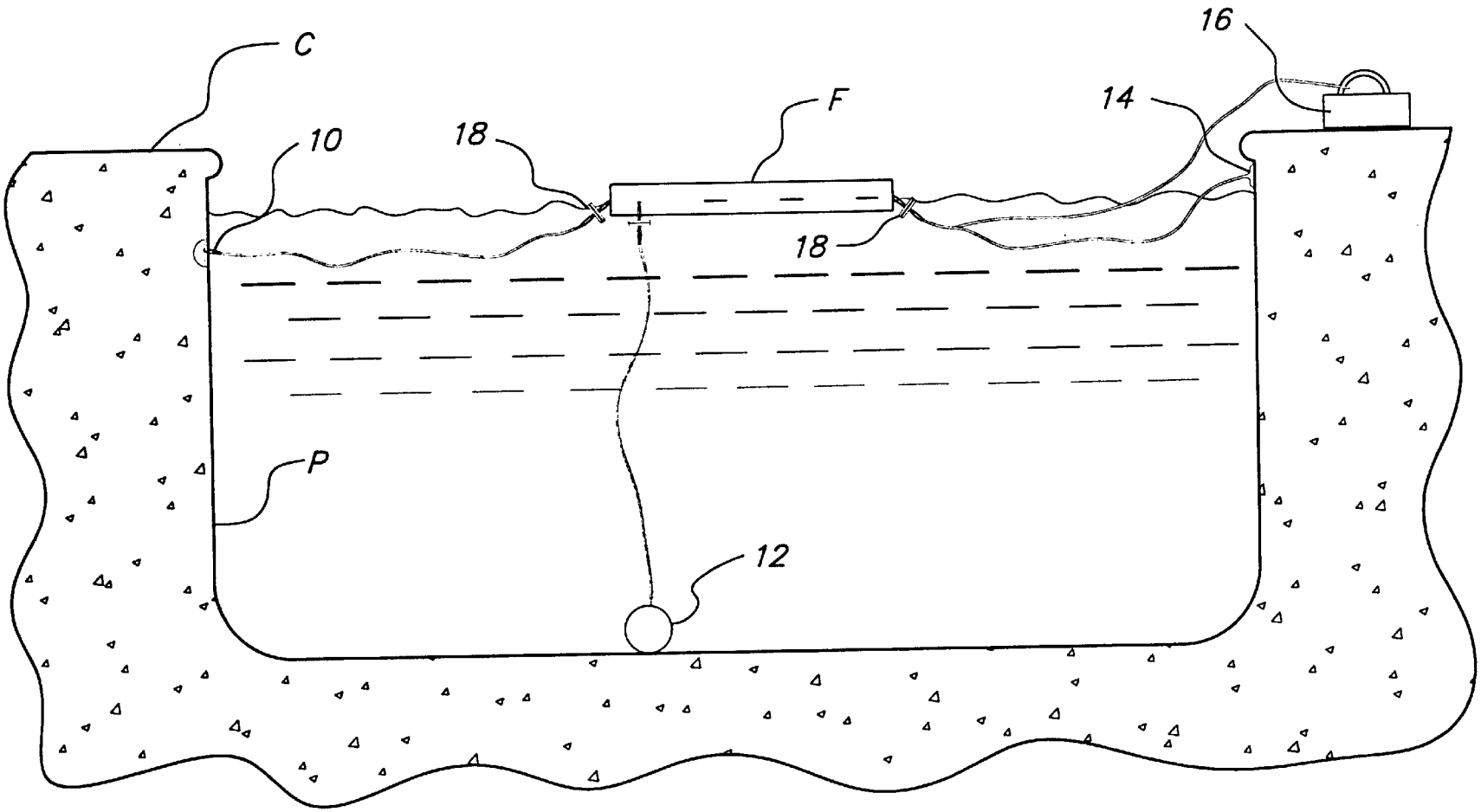
FIG. 2 is an environmental, cross-sectional view through a swimming pool, and illustrating a floating devices connection and/or storage system, and anchoring features of the system according to the present invention.

Turning now to FIG. 2 the interconnection system of the invention in a pool P environment is diagrammatically illustrated, again the view being simply a representative sample of the invention. Generally stated, the connectors shown include double male-female connectors at the float F, and then cords or lines, and then securements at the other ends of the lines, for connection to (by way of examples) one of a number of rope pins 10 built into a side wall of the pool, a weight 12 lying on the bottom of the pool, a suction cup 14 adhered to a side wall of the pool, and/or a weight 16 placed on coping C near the edge of the pool P.

Figure 3:
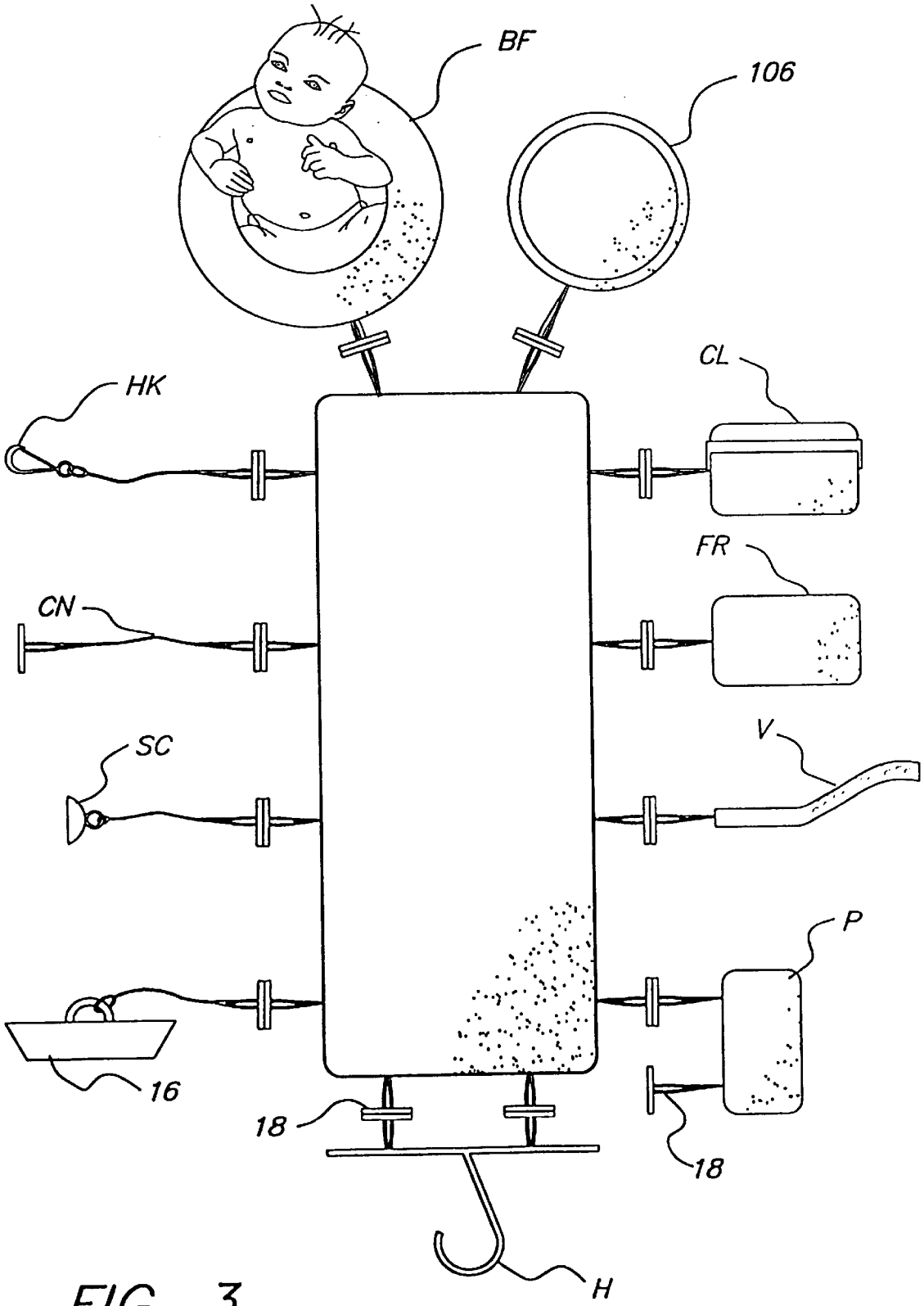
FIG. 3 is a top plan view of a float configured according to the present invention, and diagrammatically illustrating several uses of the invention in both connecting other devices to the float and connectors for a storage hanger system.

With reference now to FIG. 3, a representative float F is shown, with peripheral connectors 18 therearound. The preferred connectors 18 will be described more particularly later. Starting at the bottom, connectors 18, for example, are seen for hanging the float F for drying and/or storage. A hanger H represents one of many different ones which are discussed below. Then, proceeding clockwise, are an anchor or weight 16, a suction cup attachment SC, an extension connector CN of any type or configuration, including one of those described later, a hook HK (a type of connector, obviously), a baby float BF, a floating table 106, a cooler CL, a floating foot rest FR, a Velcro$^{tm}$ strip V (having both hook and loop or either hook or loop, for attachment to a mating loop or hook attached to some item), and a pillow P. In short, the purpose of FIG. 3 is to illustrate the useful addition of an extension means and to emphasize the wide variety of application of the connection system of the present invention.

Figure 4:
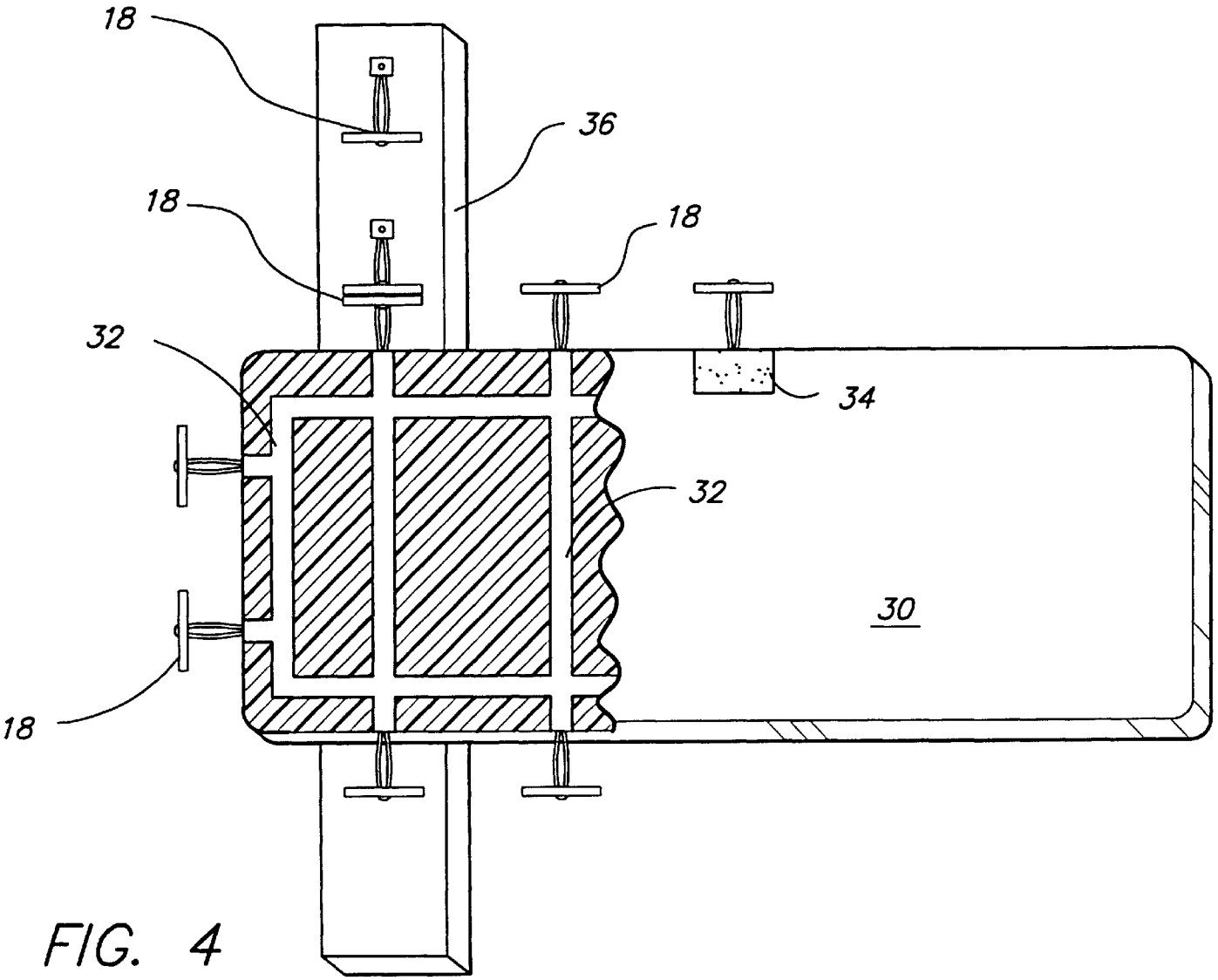
FIG. 4 is an elevational view, partly in section, showing float with hermaphroditic connectors and a float being storage-suspended, and further shows that an internal framework and connectors may be molded in unitary fashion, as one piece.

Turning now to FIG. 4, a float or mattress 30 made in accordance with the present invention will be described. Float 30 is of sandwich configuration, split centrally to receive an interior webbing matrix 32 with outboard connectors 18 arrayed therearound. The purpose of the webbing matrix is to lend strength to the float 30, so that any tugging on any one or more connectors 18 is not likely to result in separation of the connectors from the float or mattress 30. As is clear from the left hand portion of FIG. 4, the webbing matrix 32 and the several connectors 18 are of one-piece, molded construction; this structure is both secure in construction and low in manufacturing cost. The cord 20 of the preferred connector 18 is molded with a central hole to accept the dowel of a mating connector.

To the right in the view is shown another embodiment of a base for connector 18, which is also of one-piece construction, but includes a mounting pad or base 34, which is of U-configuration in cross-section, preferably, and is glued or otherwise bonded (e.g., heat bonded, ultrasonically welded, etc.) to the mattress 30. Alternatively, the base 34 could be a flat sheet, located between halves of material making up the mattress 30, and anchored if desired or laid onto one exterior surface of the mattress or float 30.

Connector 18 and base 34 may be of unitary construction, that is, molded as one piece or made of two parts which are, essentially, inseparable after manufacture. In some cases, base 34 may function as a reinforcement to protect the floating device from damage when tension or pressure is applied to a connector. These points are also applicable to the further embodiments of the invention described herein.

With further reference to FIG. 4, one half of a storage rack or vertical board 36 is shown; there would be another one to the right in the view to support the other half of the mattress 30. Connectors 18 are fixed vertically on the support 36, and these are, preferably, of the type indicated in FIGS. 5A–6 (see below), or identical to the type shown in this view and just discussed in detail. Here, it is to be fully appreciated that a connector of any type connected to a vertical surface and compatible with any connector secured to a floating device, when applied for the purpose of the floating devices and water toys interconnection system, is encompassed in the present invention. The storage board assembly may be made up of two posts (e.g., 2×4's or 4×4's) set in the ground or secured to a vertical surface.

A distinct advantage of such a storage assembly is that the item, i.e. mattress, to be stored is spaced away from any rear wall (not shown), thus assuring free air flow around and about the mattress to assist in the drying of the same and, equally importantly, reducing the possibility of the formation of mold and mildew on the item being stored. This is a significant problem, especially in southern climes, and is fully addressed by the structure shown.

It will be appreciated that one or the other type of connector on the mattress 30 as shown in FIG. 4 will be arrayed in spaced fashion all around the periphery of the mattress 30. Preferably, there would be four connectors on each long side of the float 30, and two more at each shorter end. The number may be increased or decreased as desired. It is further noted here that the mattress 30 could be of most any shape or size, from a small float with cutouts for a cooler and/or drinks, to a large lounge-type, floating mattress chair, a tube, a ring, etc., and that the matrix 32 could be on one side of a solid mattress construction instead of being sandwiched between to halves as just shown. Or, if desired, the mattress 30 may be inflatable. The attachment of a matrix 32, base 34, and connector 18 may vary depending on the materials compatible with each part of the selected embodiment (e.g., sewing, heat or glue bonding, molded into). These points are true also of the additional embodiments which will be detailed below.

Figure 5A:
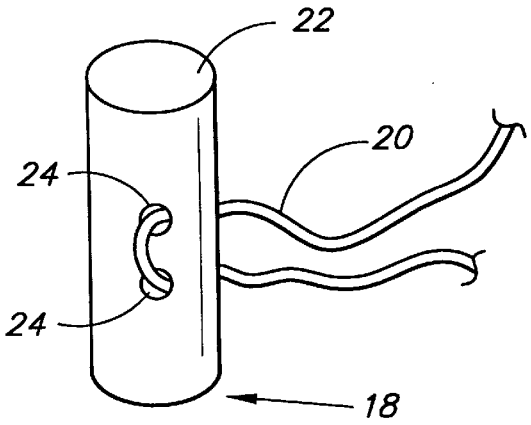
FIGS. 5A, 5B and 5C are enlarged scale perspective views showing a hermaphroditic connector, two such connectors partially assembled, and two such connectors fully assembled, respectively.
Figure 5B:
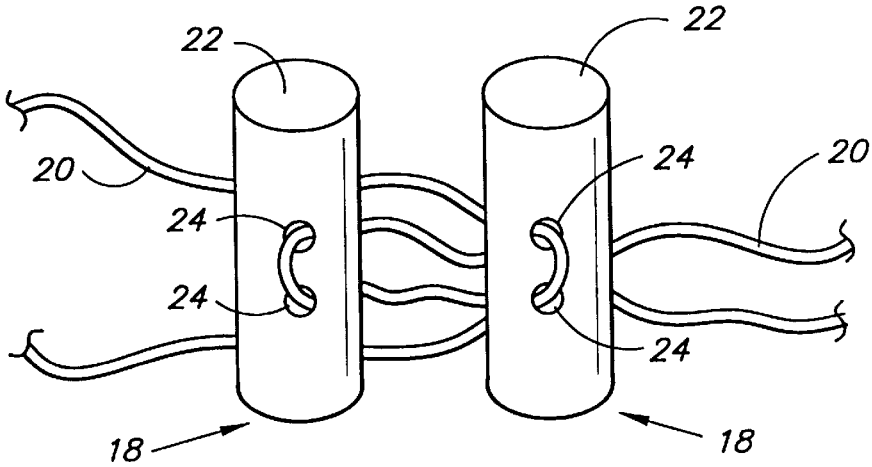
Figure 5C:
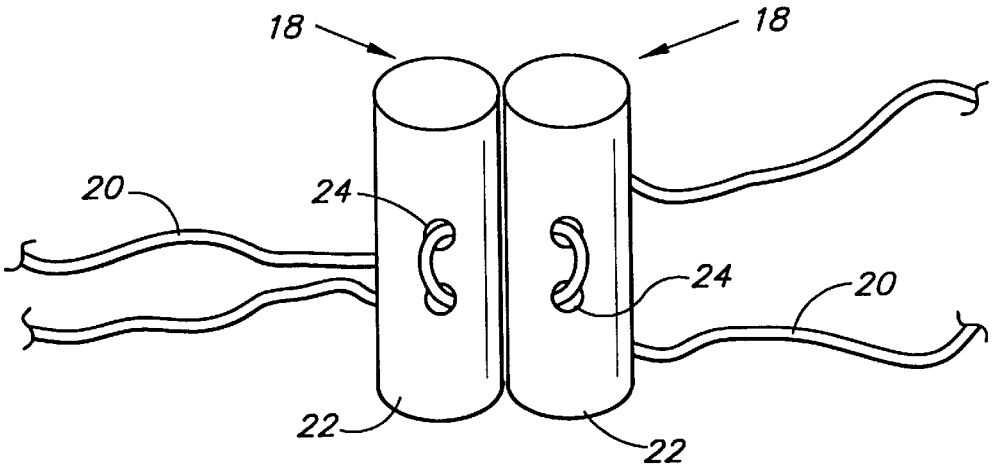
Figure 29:
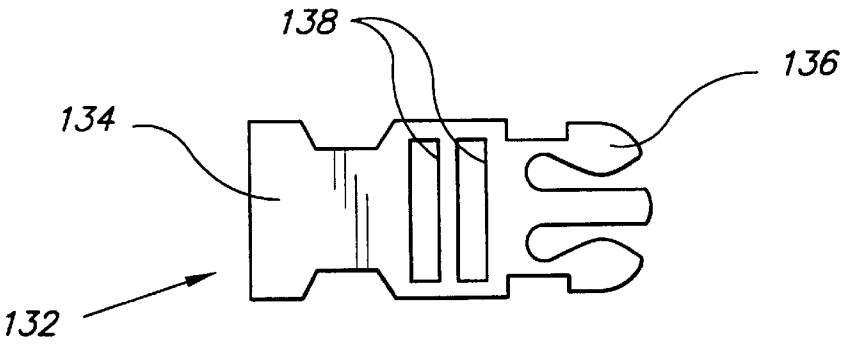
FIG. 29 is an elevational view of an hermaphroditic dual ladder-lock, side-release clip according to this invention.
Figure 30:
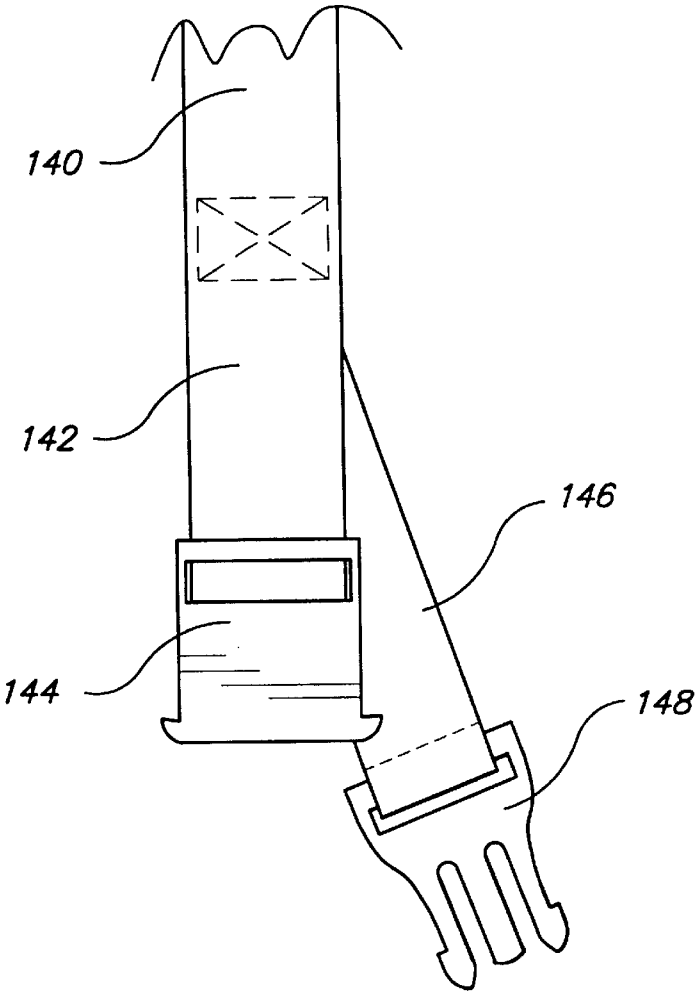
FIG. 30 is a perspective view of another hermaphroditic clip connector similar to that of FIG. 28, but with combined connectors.

With reference to FIGS. 5A, 5B and 5C, the preferred hermaphroditic connectors 18 of the invention will be discussed. As the term implies, these connectors are identical in nature, each being made up of a length of cord material 20, with its free ends secured or fixed to an object to be connected, and a dowel 22, centrally through-bored at 24, 24 to accept its length of cord 20. The cord is preferably made of either non-floating material (e.g., nylon) or floating material (e.g., polypropylene). The dowel is made of plastic, but other materials such as metal, foam, rubber, wood, or a combination of two or more materials might be used in selected applications. Alternatively, and as was explained in greater detail above, the connectors 18 may be of one-piece construction, dowel and cord together, and molded from a suitable material (e.g., plastic, rubber). It is further noted that while the hermaphroditic connector 18 is the preferred hermaphroditic connector of the present invention, any connection device having means for both male and female interconnection, being constructed of one piece or more than one piece (e.g., as seen in FIGS. 29 and 30, and described below) are encompassed in the present invention. These points are true of the additional embodiments which are herein described.

Figure 6:
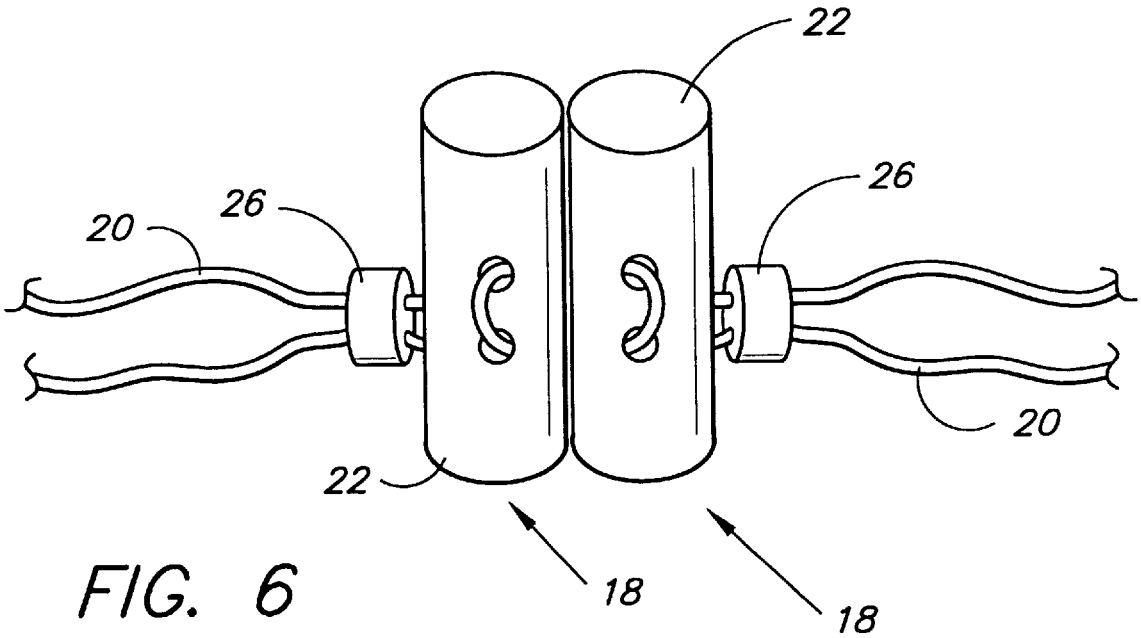
FIG. 6 is a view similar to FIG. 3 but showing friction fit keepers holding the connector in assembly.
Figure 7:
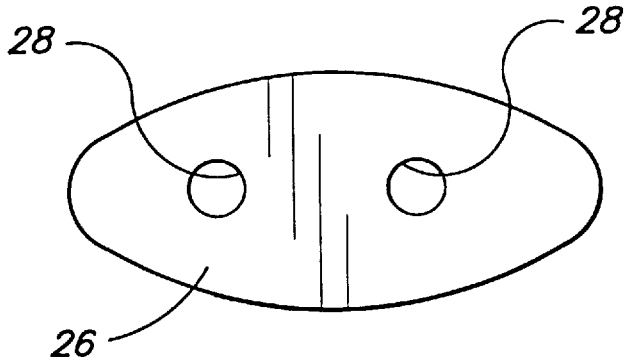
FIG. 7 is an enlarged scale plan view of a keeper of the type shown in FIG. 4.

The use of two connectors to secure objects together is readily apparent from an inspection of FIGS. 5B and 5C. As seen in FIG. 5B, the respective dowels 22 of each connector are inserted through loops formed by the cords 20. Then, the dowels are brought together, or more likely, each cord 20 ends are pulled, until the connectors 20, 20 are joined together, as seen in FIG. 5C. For optional further security of the interlocked connectors 20, 20, a semi-rigid slide lock in the form of a keeper 26 is used, as best illustrated in FIG. 7. Keeper 26 is through-bored at 28, 28, to accept a cord 20 threaded therethrough. FIG. 6 illustrates the use of two keepers 26, 26, in use with respective connectors 18, 18. Keepers 26, 26 are simply drawn up against the respective dowels 22, 22 of the opposed connector, thus to immobilize one connection device 18 against the other.

Figure 8:
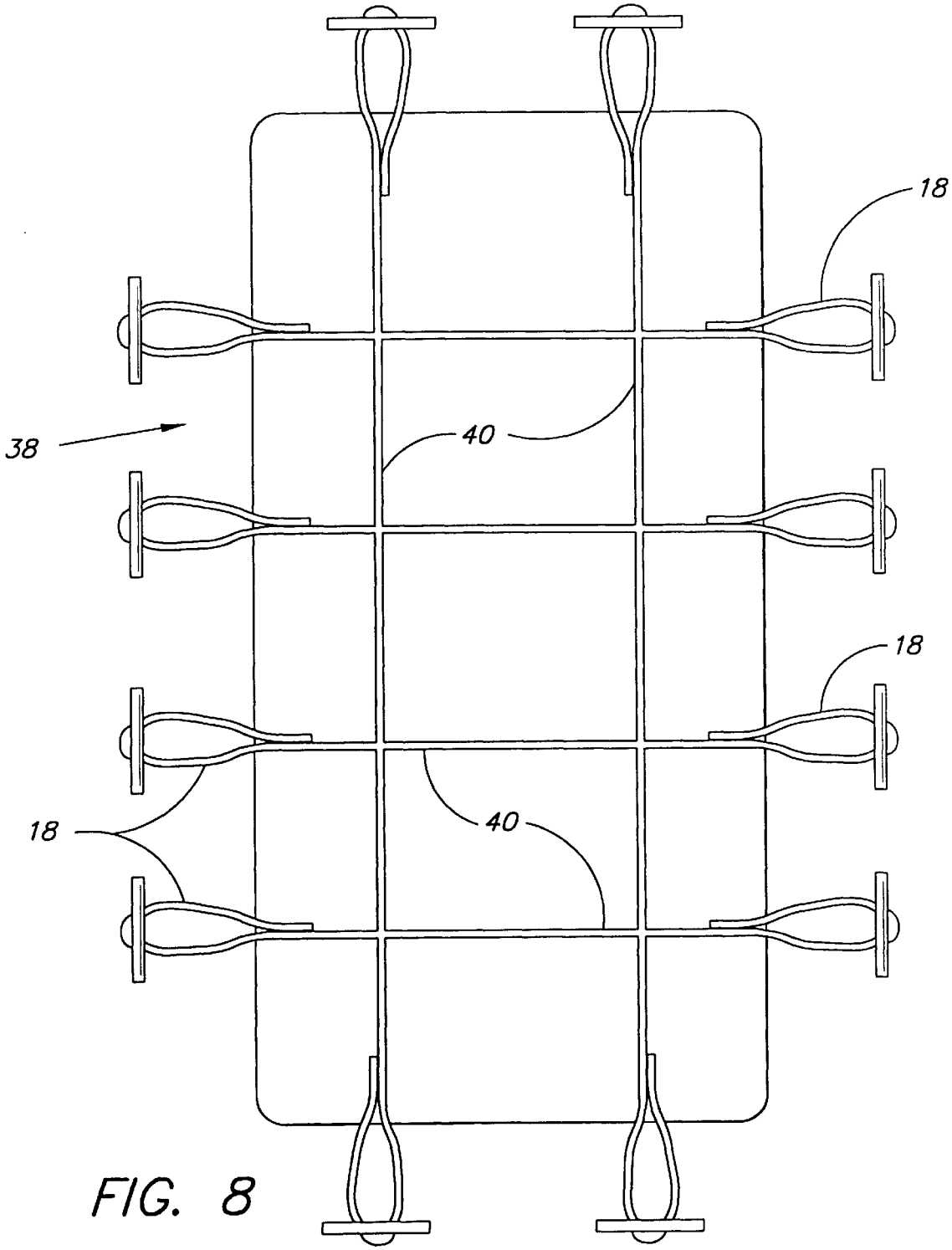
FIG. 8 is an interior plan view of one embodiment of a float or pad constructed according to the teachings of the instant invention.
Figure 9:
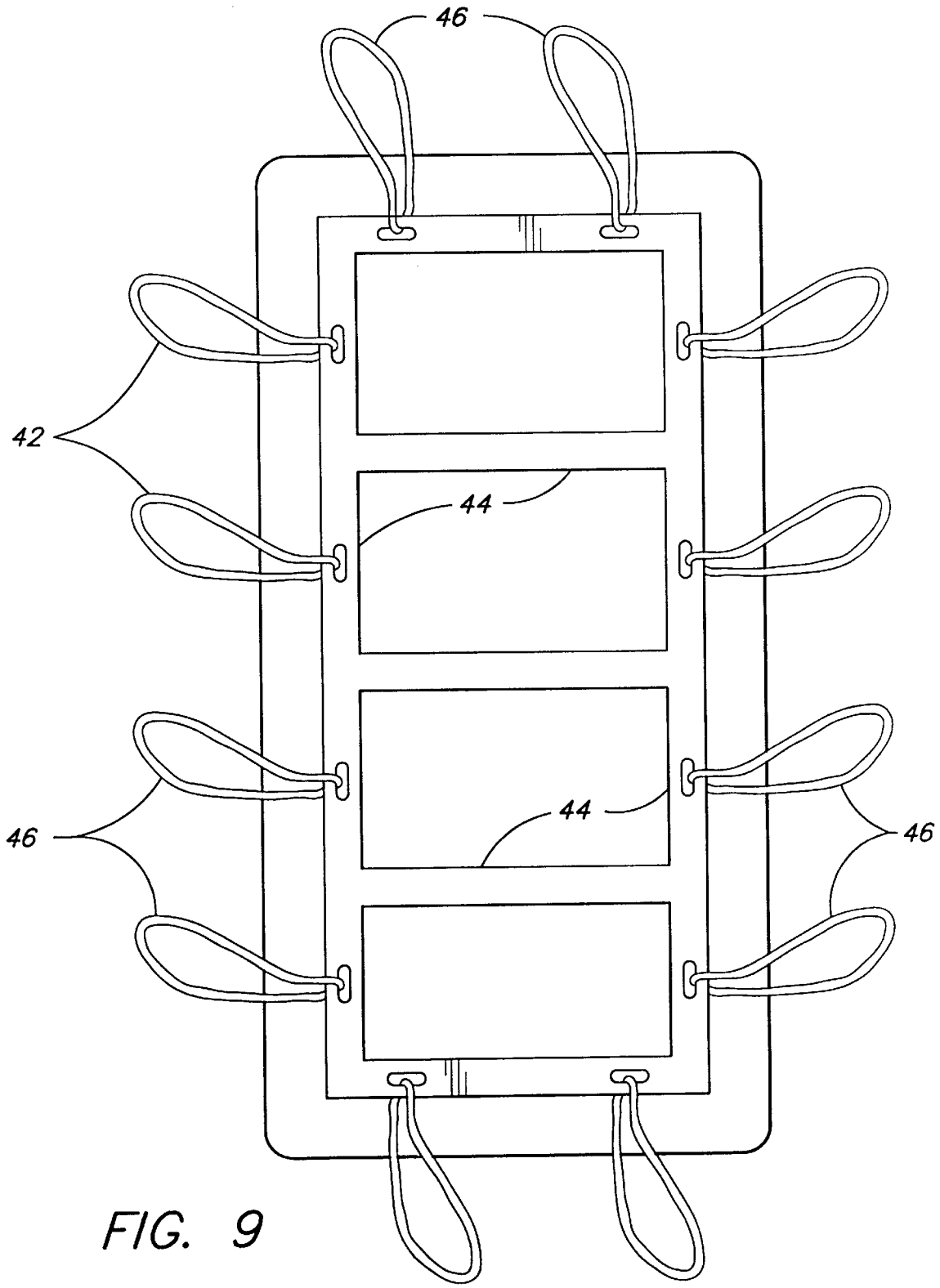
FIG. 9 is an interior plan view of a second embodiment of a float or pad constructed according to the teachings of the instant invention.
Figure 10:
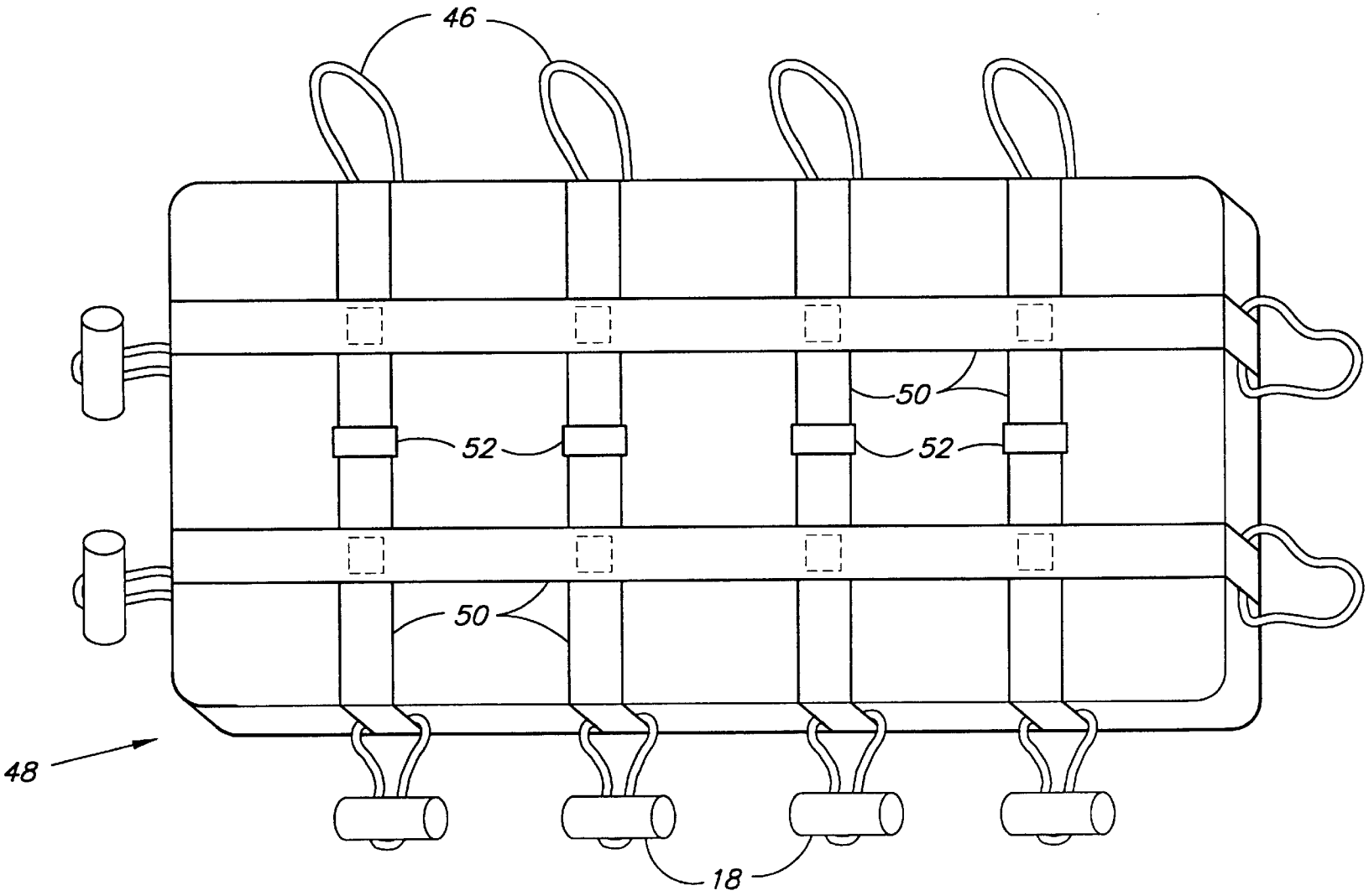
FIG. 10 is an interior plan view of a third embodiment of a float or pad constructed according to the teachings of the instant invention.

FIGS. 8, 9 and 10 illustrate additional types of mattress constructions, these being variations on the theme discussed above with respect to FIG. 4. In FIG. 8, a lower half of a mattress 38 with a cord matrix 40 sandwiched between half 38 and an upper half (not shown). An array of connectors 18 are about the periphery of mattress 38. The cord ends for the connectors 18 of the matrix 40 are doubled back on themselves and secured, as by sewing, heat or glue bonding, etc., to the adjacent cord body. In FIG. 9, a pad 42 is shown with a central matrix 44 and loop connectors 46 therearound. Connectors 46 may be of the type earlier described, or may be loops as shown, connected to connectors 18 (see FIG. 5A) and a keeper 26 (FIG. 7) could be used on one or both sides of each connection for security of the connection. FIG. 10 shows a mattress or pad 48 with a surrounding webbing matrix 50 and either connectors 18 or 46 could be used. The webbing matrix may be on the exterior, or beneath a vinyl coating, should the mattress 48 include such a coating. One or the other or a mixture of both connectors 18, 46 may be provided about the periphery of mattress 48, secured of course to the matrix 50. Additionally, and if desired, some sort of buckles 52 may be included in the matrix 50, for transfer of the matrix 50 to a new or other pad when desired.

Figure 11:
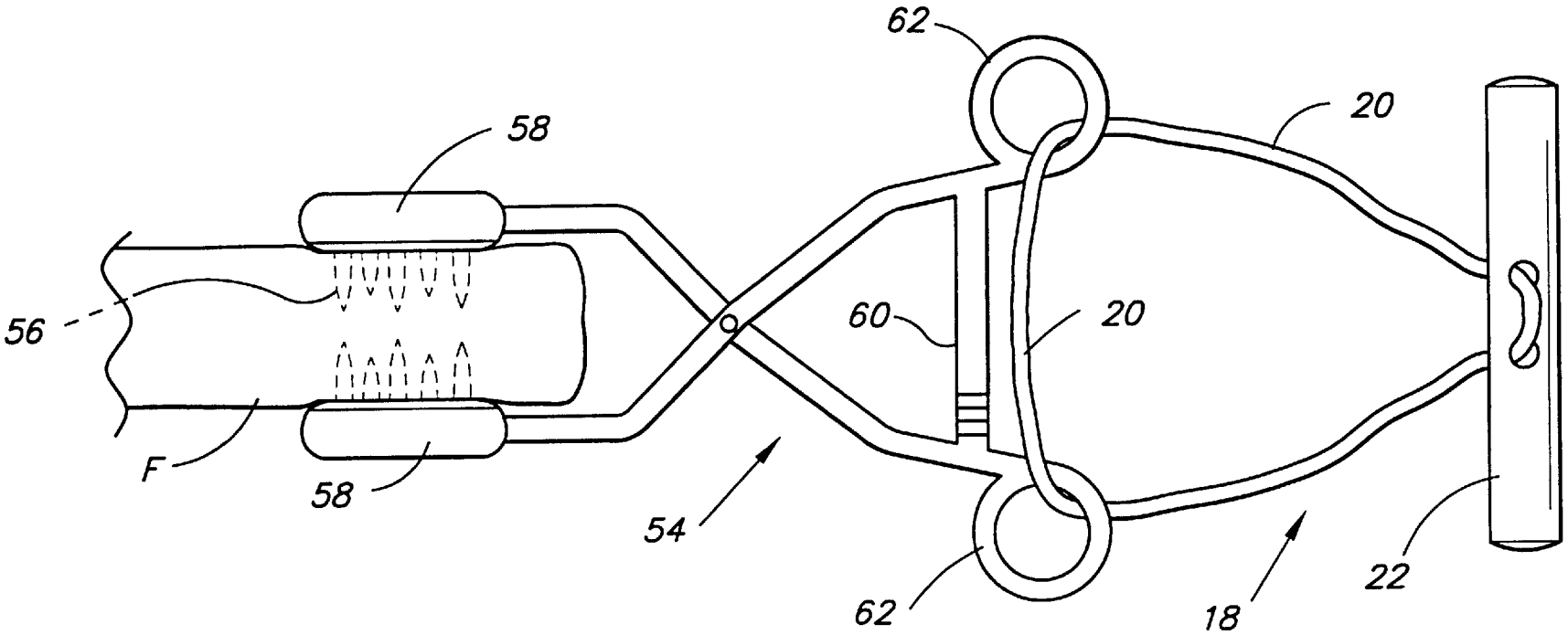
FIG. 11 is an elevational detail view of yet another connector made in accordance with the teachings of the present invention.

A slightly more exotic but eminently practical structure for latching a connector 18 to a pad is illustrated in FIG. 11. This assembly or a similar structure is particularly useful for after-market use. A pad or float F is generically indicated and a connector 18 is shown. A scissors-configured clamp 54, structured rather similarly to a medical arts hemostatic clamp, may include teeth 56 on opposed supports 58, which dig into the pad or float F. A latch 60 of opposed, cooperating steps, again similar to those found on a hemostatic clamp, secure the clamp in place. The cord 20 of a connector 18 is threaded through the handle loops 62, 62 of clamp 54. Alternatively, or in conjunction with the teeth 56, the clamp may include a semi-rigid lining (not shown) which is permanently or removably attached to the clamp, and is sandwiched between the floating device and the clamp. It is further noted that a variety of currently manufactured clamps may be incorporated by the addition of a hermaphroditic connector to the clamp base for after-market application.

Figure 12:
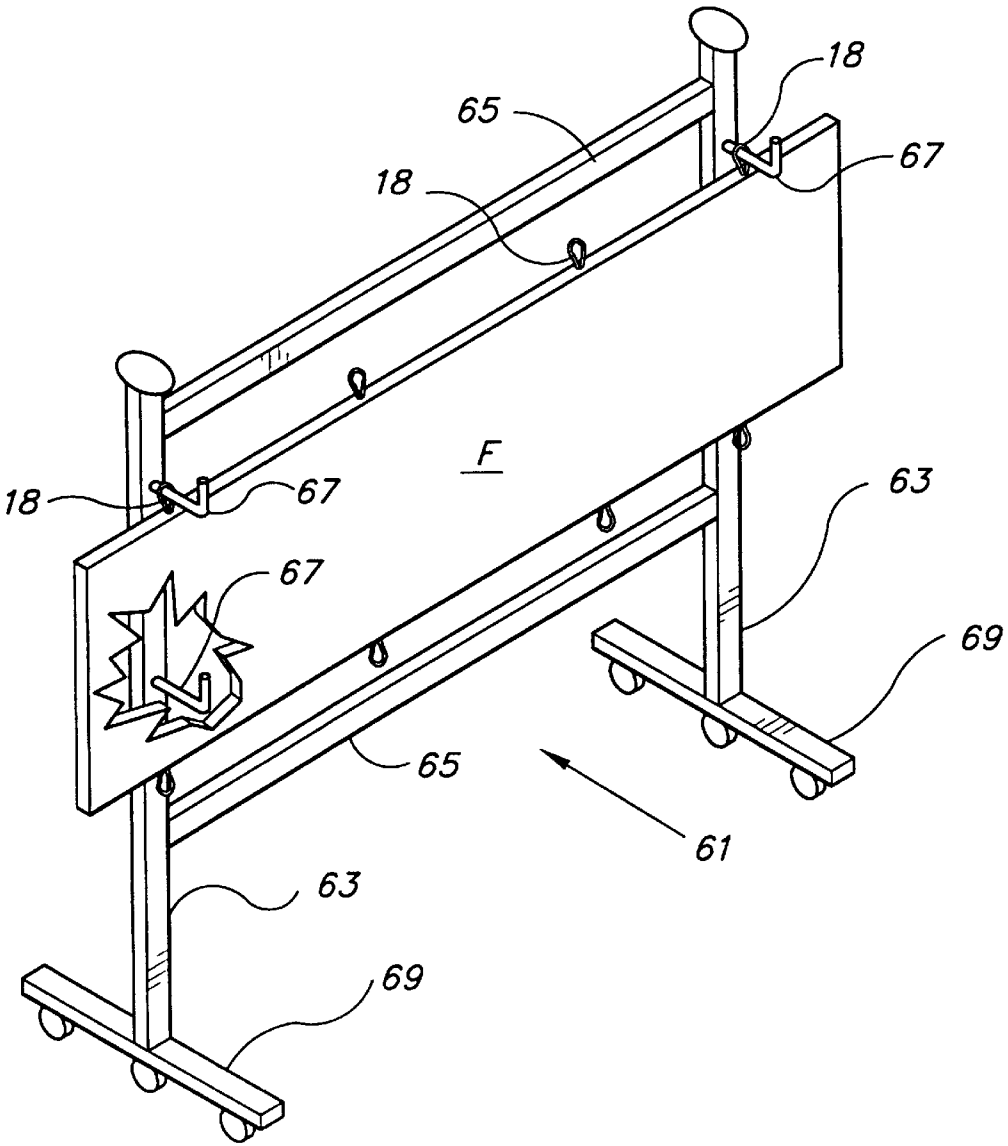
FIG. 12 is an elevational view of a storage system of the invention, including supports mounted on optional supports having caster wheels, a portion of a suspended float being broken away to reveal interior detail of the suspension hooks.

Turning now to FIGS. 12 through 16, inclusive, storage systems of the invention will be discussed. In FIG. 12, a stand or portable rack 61 includes a pair of uprights 63, 63, and optional upper and lower cross braces 65, 65. The completely open nature of the rack construction allows air to circulate around and about any float or other item suspended on the rack, thus to promote rapid drying, and reduce the possibility of mold and/or mildew formation. During this discussion, one or more floats F are shown, but it is to be understood that any water float or toy needing drying and/or storage is to be encompassed by the term "float." Hooks 67 are arranged in horizontal pair fashion on uprights 63, 63, and float F having connectors 18 is suspended on the rack 61 by slipping connectors 18 over a pair of hooks 67, 67. Now, the specific connectors 18 do not necessarily have to be provided on float F. Any sort of loop or, perhaps, a peripheral line or rope about float F can be employed to suspend the float on the rack, for drying and/or storage. The uprights 63 may have any sort of connector attached thereto which can be employed to suspend a floating device in place of the hooks 67. For portability purposes, caster wheeled bases 69, 69 may be provided for uprights 63, 63, so that the rack 61 may be easily moved about, from poolside to somewhere away from the pool for drying, or to a garage for longer term drying and storage. It should be noted here that any one of a wide variety of wheeled bases may be incorporated to provide portability of the rack. Furthermore, additional hooks 67, 67 may be provided and used to suspend additional floats or other water toys and devices on the same rack, and may also be attached to one or both sides of the cross braces 65.

Figure 13:
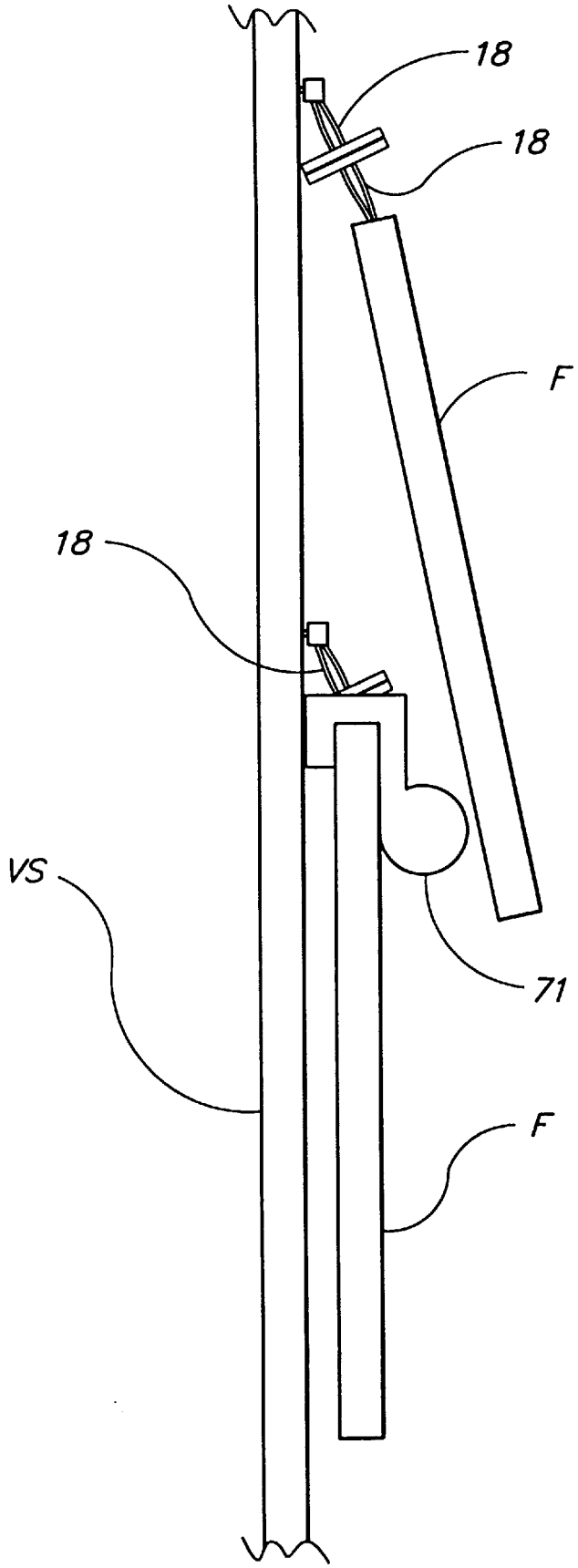
FIG. 13 is a side elevational view of another storage system according to the invention.

An additional storage system is illustrated in FIG. 13, which may be permanently or removably fixed against a vertical surface VS, or which can be used as a part of the stand or portable system shown in FIG. 12. The vertical surface VS includes the uprights 63, 63 just discussed, a wall, a pair of two by fours, etc. Two floats F, F are shown suspended, each by pairs of connectors 18, 18, one on the float F and one mounted by any suitable means on the surface VS. Another pair of connectors 18, 18 are provided for the other end of each float F. A pair of spacers 71, 71 are mounted over the lower of the two floats F, to keep the upper away from the lower, and allow enhanced drying air circulation over and about both of the floats F, F.

A variation on this theme is seen in FIGS. 14, 14A and 14B. Here, spacing ledges 73, 73 are seen for enhancing air flow about a float F. The edges of the ledges may be configured so as to allow water to run off of the ledge 73, and also to prevent the float being dried from sticking to the ledge, or the ledge leaving a mark or stain on the float. A scalloped edge is seen in FIG. 14A, and a dadoed edge is seen in FIG. 14B.

Figures 15A, 15B:
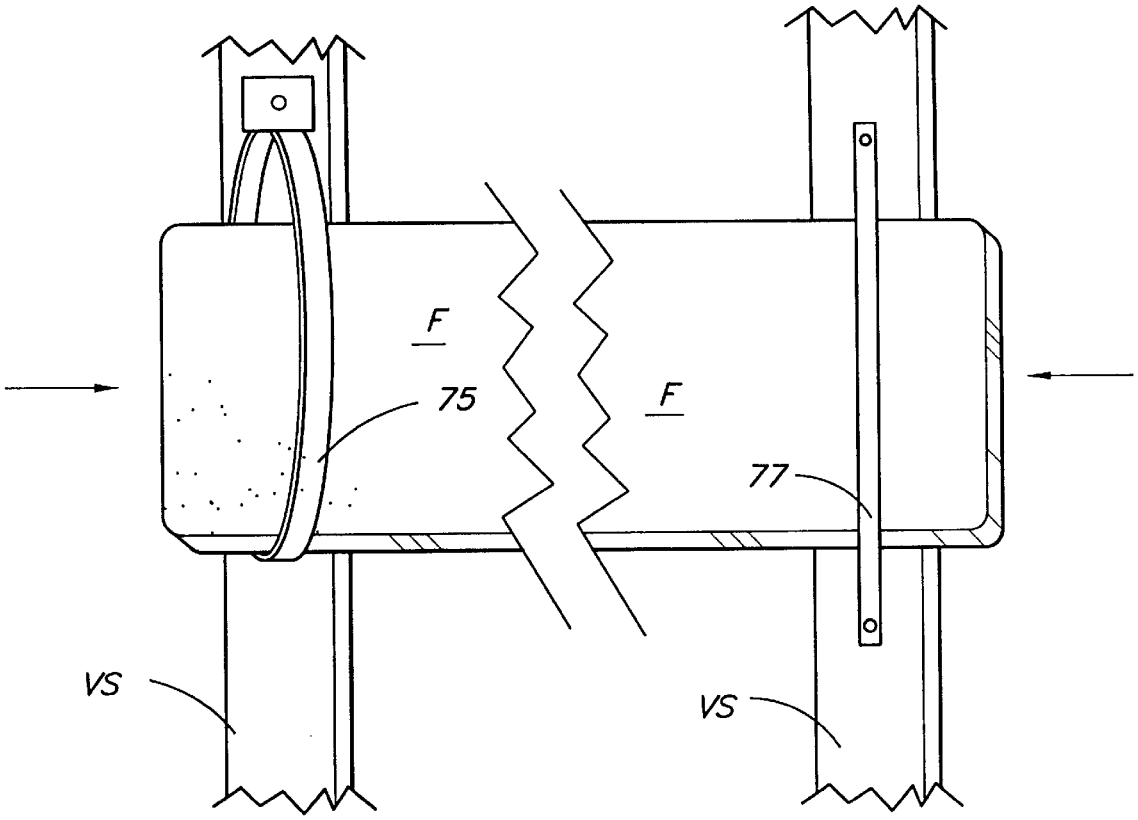
FIGS. 15A and 15B are elevational views of additional suspension means for a float or the like, in a storage system of the invention.
Figure 16:
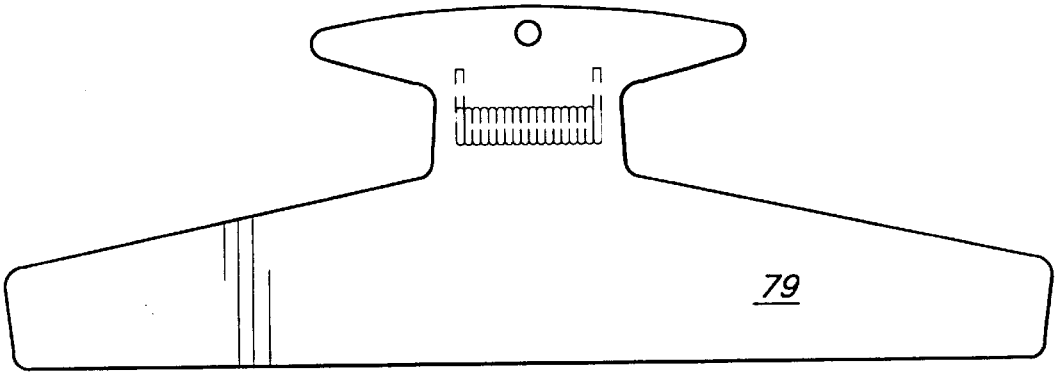
FIG. 16 is an elevational view of an oversized clip which may be used to hold items in suspended storage.

The means for suspending the float F from a vertical surface and not needing the connectors 18, 18, or any other form of connector, may take forms such as shown in FIGS. 15A, 15B and 16. A loop 75, FIG. 15A, or a strap 77, FIG. 15B can be provided; obviously, these are used in pairs. Or, an oversized clip 79 shown in FIG. 16 may be used. Clip 79 is similar to a potato chip bag clip, with a central spring which may be varied in tension for light to relatively heavier items to be suspended.

Figure 17:
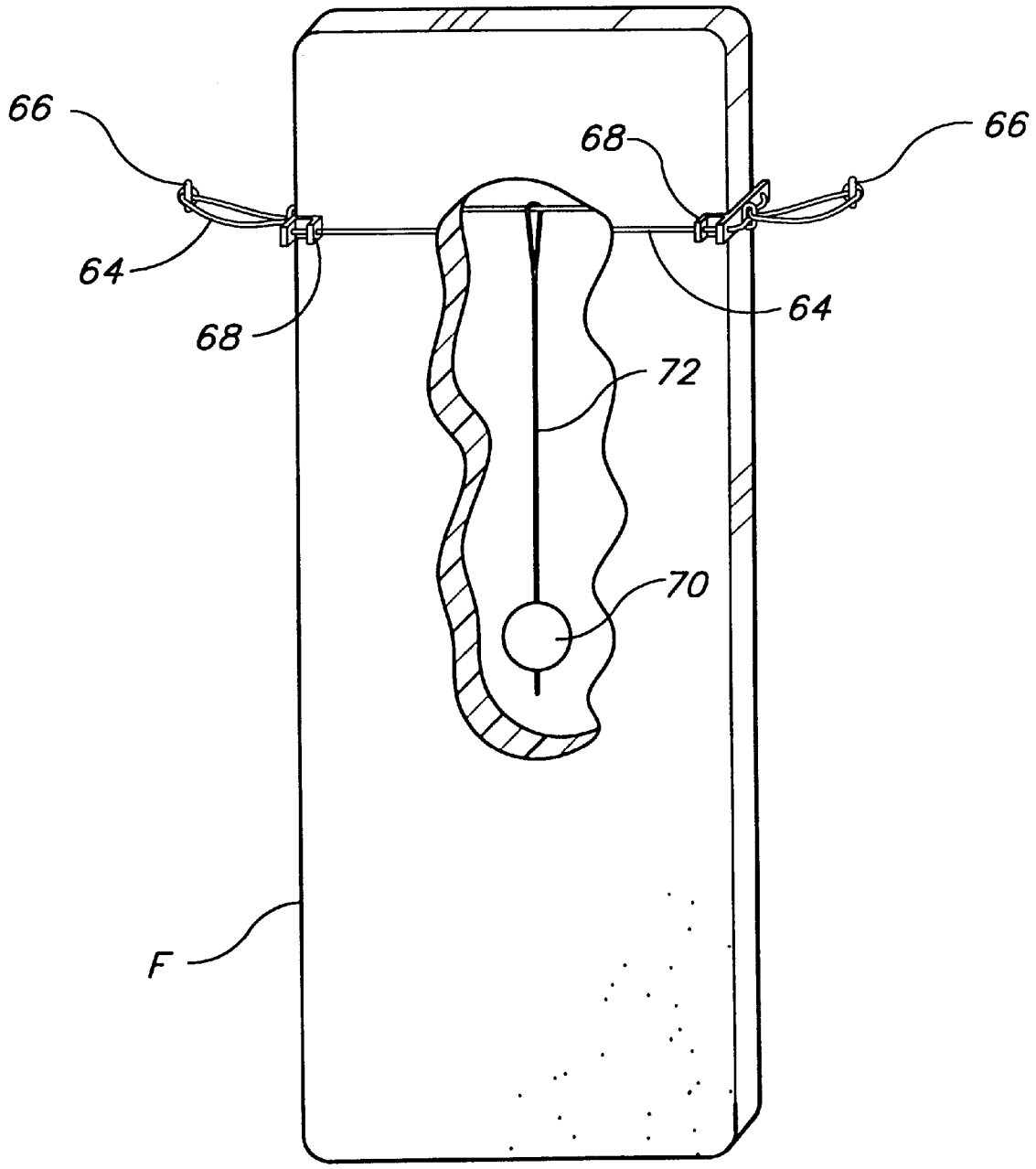
FIG. 17 is an elevational, perspective view of a storage system of the invention, parts broken away to reveal a spacer ball on a tether, behind the stored float or pad.
Figure 19:
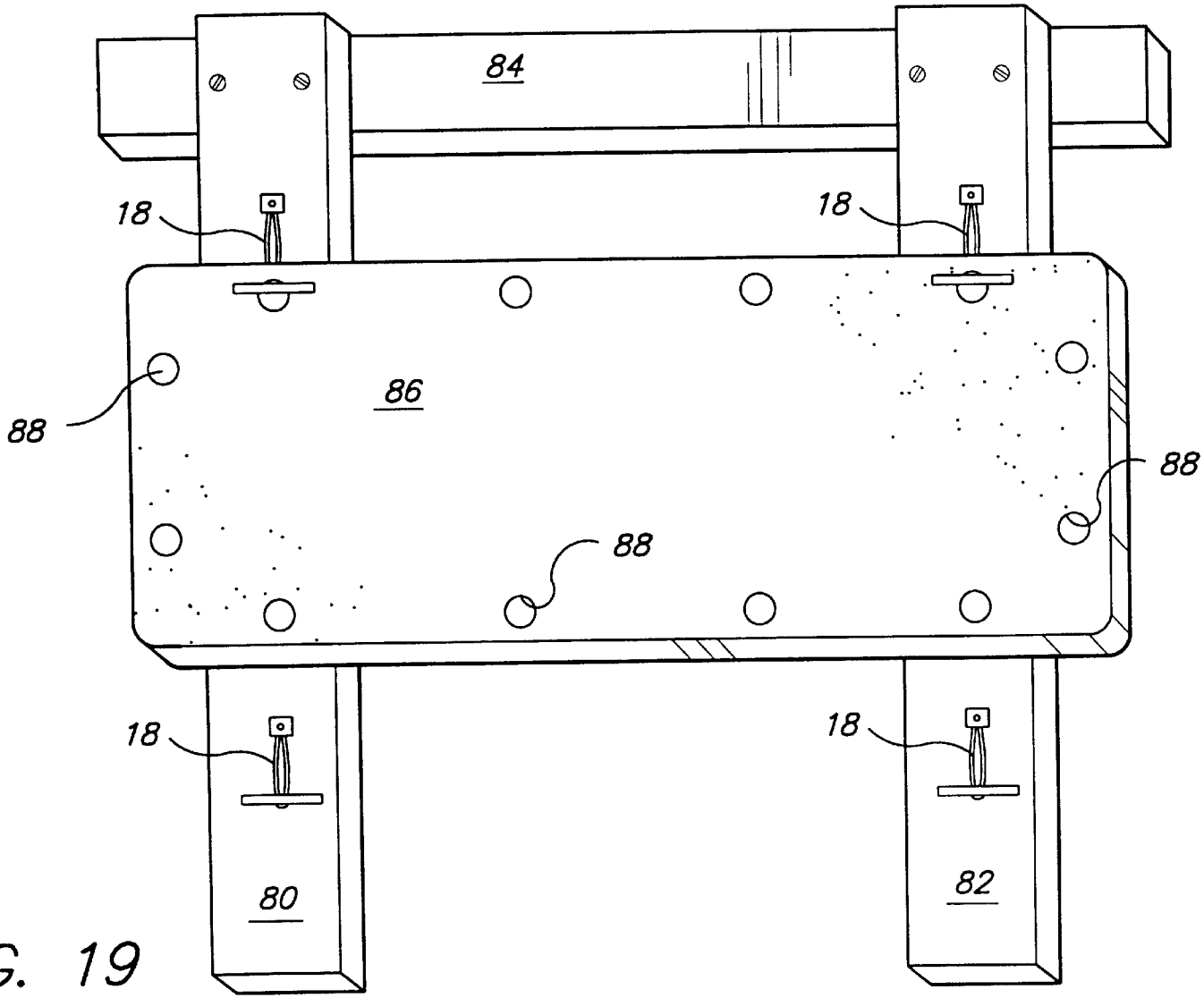
FIG. 19 is an elevational, perspective view of another embodiment of a float and storage system for the same, according to teachings of this invention.
Figure 20:
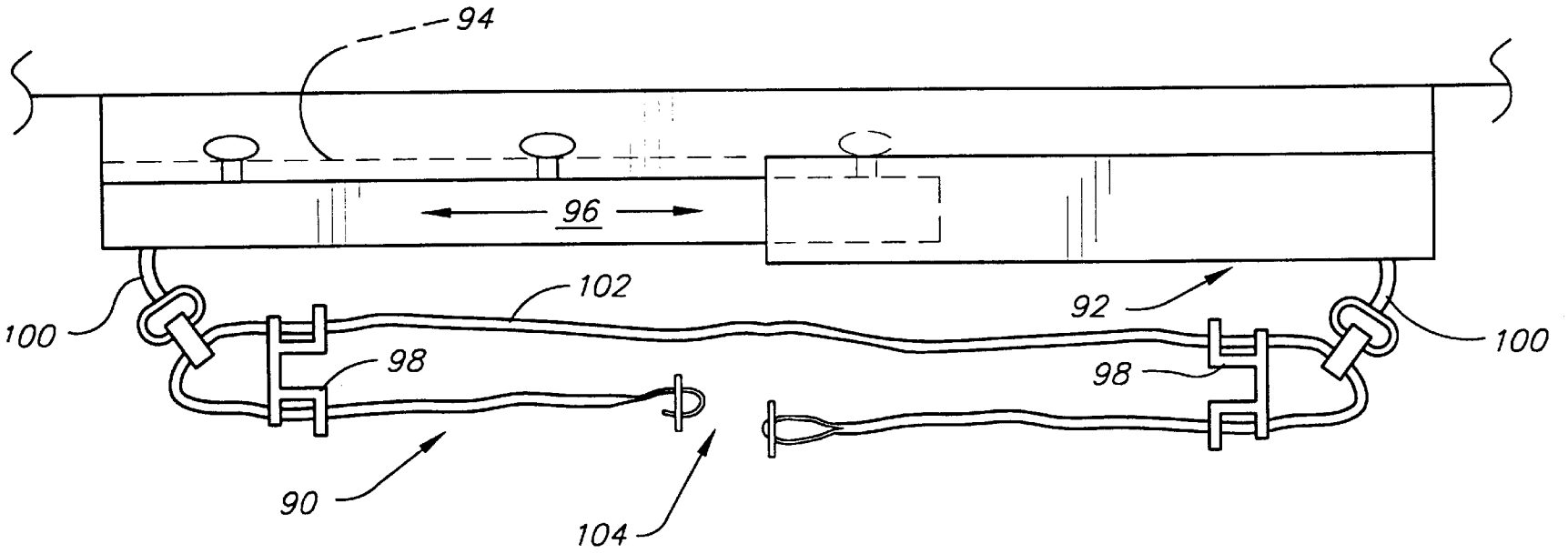
FIG. 20 is a top view of yet an additional embodiment of a float storage system, which is adjustable in length to accommodate a wide variety of differently-sized floats and water toys.

Additional storage structures will now be discussed, with reference to FIGS. 17–22. In FIG. 17, a float F is suspended by a cord arrangement 64, from wall hooks 66, 66. Side supports 68, 68 are provided so that the portions of float F where suspended do not take a "set" from a long storage time, as could occur if these supports were not provided. Furthermore, an optional spacer 70 (in the form of a ball, for example) is located behind float F, to assure that air may circulate fully about the float for drying the same, and preventing the formation of mold and mildew. A line 72 suspends the spacer from cord arrangement 64. A variation for the optional spacer 70 could be, for example, a half ball attached to the vertical surface at the desired location for a spacing means. In FIG. 18, the float F is similarly suspended, the cord arrangement 64 starting with a first loop 74, going through a support 68 and behind the float F and supporting a line and spacer (not shown), then out through a support 68 and around a wall hook 66, and back through the side supports 68, 68 to a second loop 76; the loops 76 are then placed over a second wall hook (not shown). In FIG. 19, the suspending support 78 is similar to that first disclosed in FIG. 2. Vertical support boards 80, 82 depend from an optional horizontal board 84. It is further noted that the optional horizontal board 84 may be implemented in a pair or more of such boards, and spaced vertically to improve the support of the vertical boards as desired and necessary to provide secure attachment to a vertical surface. A float 86 is depicted having a plurality of peripheral connection and suspension holes 88 therearound, through which connectors 18 are inserted as shown. An adjustable rack 90 for supporting a float is seen in FIG. 20, including a base 92, attached to a wall or fence, a track 94 and a slide support 96, movable along the track 94. Support 96 slides back and forth to accommodate differently sized floats. Protectors 98, 98 hold the float in storage and supports 100, 100 assure that the suspended float is spaced away from the base and supporting wall or fence so that air circulation about the stored float is assured. The float or cushion F is held in place by an elastic cord 102 which is adjustable (e.g., elastic, rope, nylon webbing) with a suitable fastener assembly 104.

Figure 21:
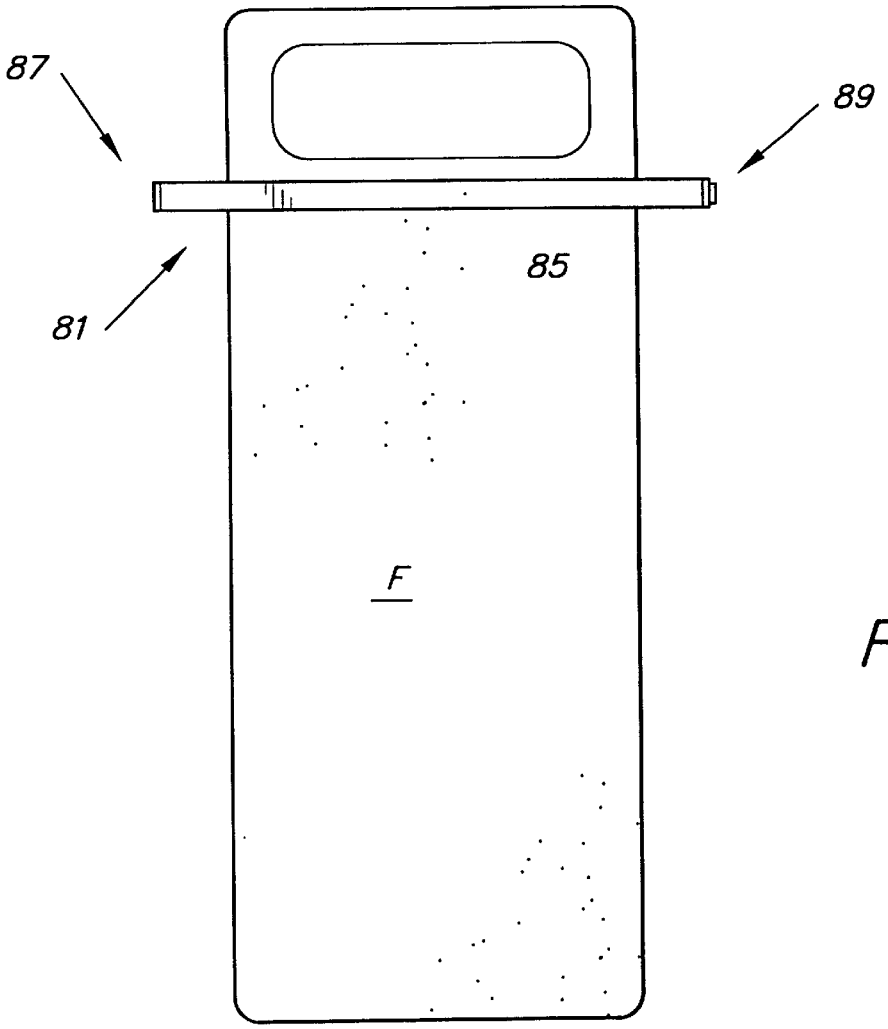
FIG. 21 is a front elevational view of another storage system with a single clasp device for holding an item in suspension storage.
Figure 22:
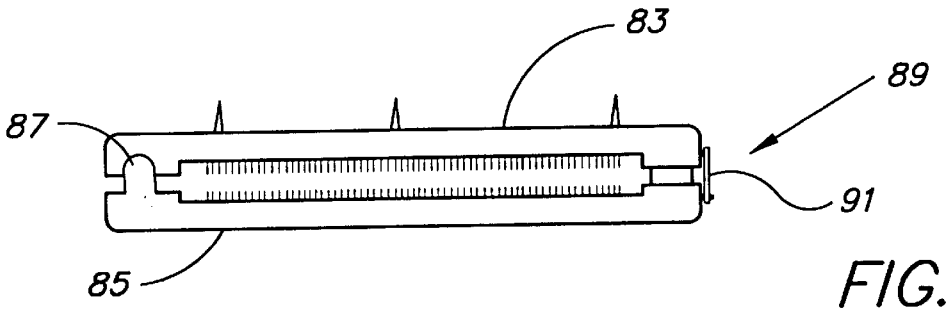
FIG. 22 is a top plan view of the clasp shown in FIG. 21.

With reference now to FIGS. 21 and 22, another suspending holder 81 is seen, including a base 83 fixed to a vertical surface by appropriate means (screws, nails, etc.) and a retaining gate 85, universally pivoted to base 83 at 87; this means that the gate is free to move up and down, and back and forth, to clamp a float F in the holder 81. The internal facing surfaces of the gate 85 and base 83 may be lined with bristles or rolled rubber, for example, to gently embrace the float F therebetween without damaging the same. The gate is held in the latched position shown in FIG. 22 by a clasp structure 89, including an elastic retaining band or loop 91. It is further noted that the clasp structure 89 may be somewhat rigid (e.g., metal, rubber, plastic) and optional incorporated on both ends of base 83, holding secure retaining gate 85 without need for the universal pivot means.

Figure 27:
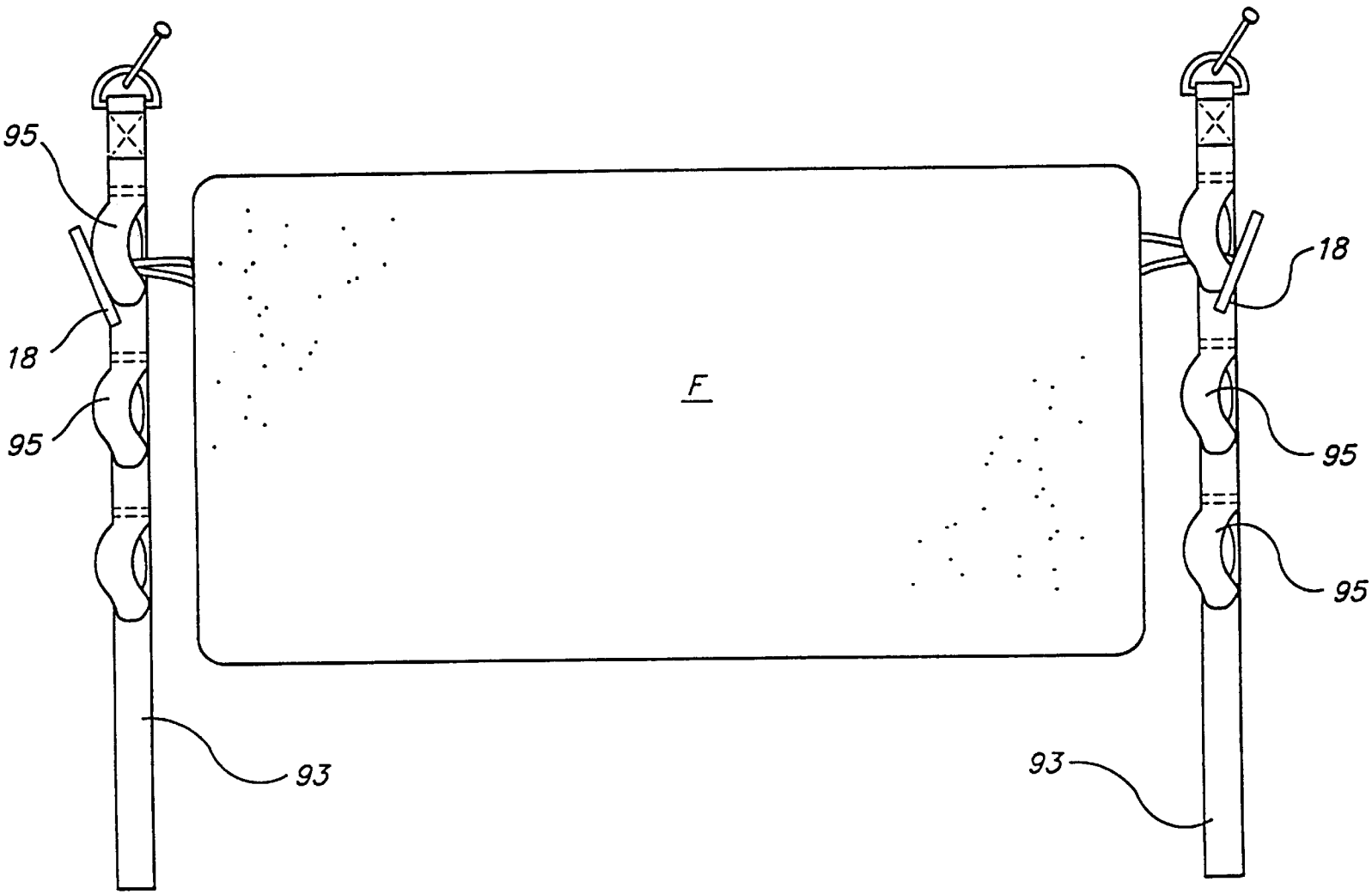
FIG. 27 is an elevational view of a very uncomplicated form of hanger, made up of two straps with loops, according to the invention.

A very uncomplicated form of suspension system is illustrated in FIG. 27. Here, a pair of simple straps 93 made of, for example, 2" wide nylon webbing with loops 95 of the same material sewn along the strap 93, are provided. A float F is suspended with connectors of any sort, e.g., 18, inserted through the loops 95. A single such strap can be used as seen in FIG. 1, for supporting an inner tube IT, with the strap 93 arrayed vertically, or a number of noodles N, for example, with the strap arranged horizontally.

By now it can be appreciated that the variety of arrangements and constructions of floats or pads or mattresses, interconnectors and storage assemblies are virtually endless. The major point is that a system has been created allowing for interconnection of floating mats, pads, floats, supports, etc. while in use so that items do not annoyingly drift apart, and for storage of items after use, easily and simply, without a lot of mess and bother. It is to be further appreciated that additional storage embodiments may be created by the combining of one or more features from one or more of the embodiments described herein; the possibilities are endless. These points are fully incorporated and encompassed by the term storage means and are included in the present invention.

Figure 23:
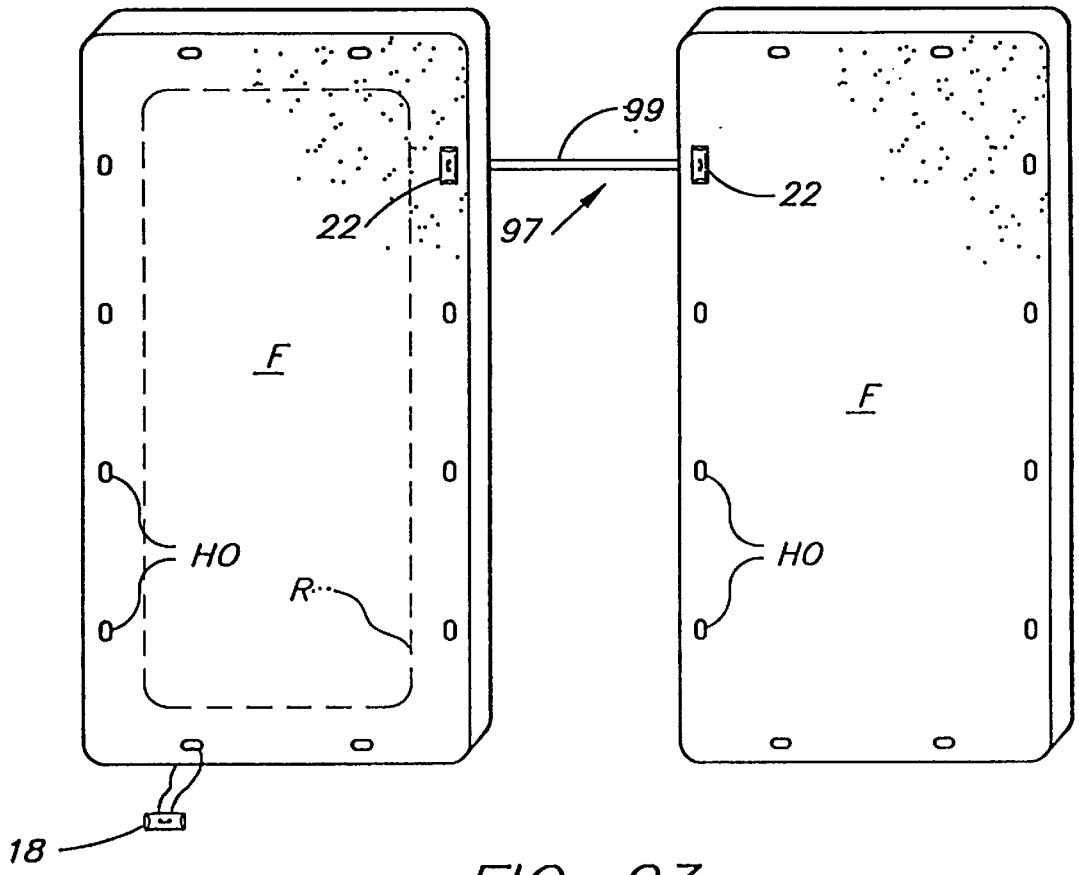
FIG. 23 is a top plan, largely diagrammatic view of two floats or rafts interconnected by a modified connector of the invention.
Figure 24:
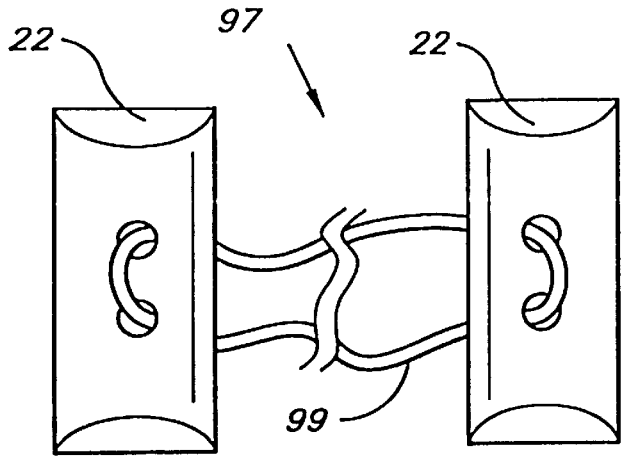
FIG. 24 is an enlarged scale view of the connector shown in FIG. 23.
Figure 25:
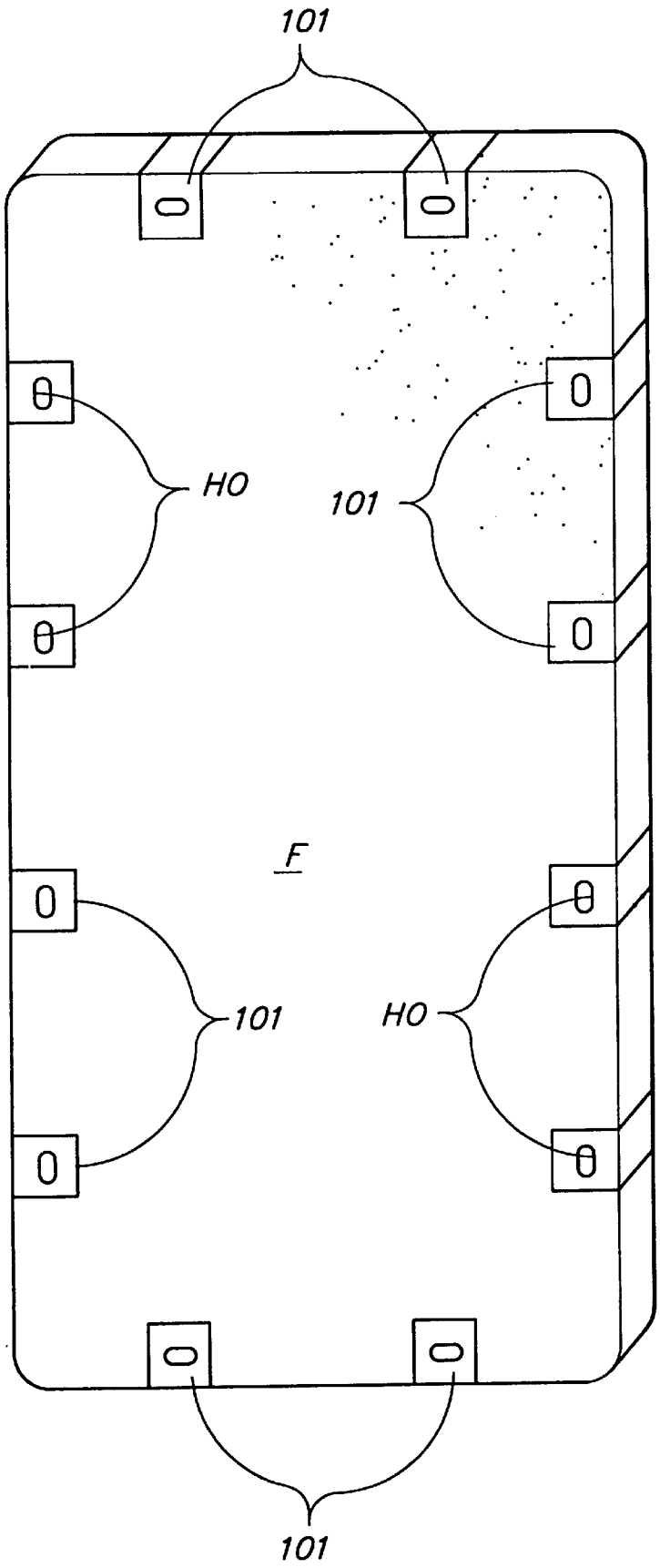

Earlier on, it was explained that the use of double or hermaphroditic connectors was a preferred method of connector construction of the present invention. Another, modified connector structure which is somewhat similar in design is seen in FIGS. 23 and 24. Two floats F, F having peripheral holes HO therearound are interconnected by an interconnector 97, made up of two dowels 22, 22 and a single endless loop 99 (made from suitable cord with ends braided or clamped together, for example). The interconnector 97 is shown in use in FIG. 23; the dowels 22, 22 are simply inserted through selected holes HO and then turned flat against the surface of each float F, F. As an alternative, connectors 18 may be used, with their cords simply threaded through a hole HO; one is shown at the bottom left of FIG. 23.

Figure 25:
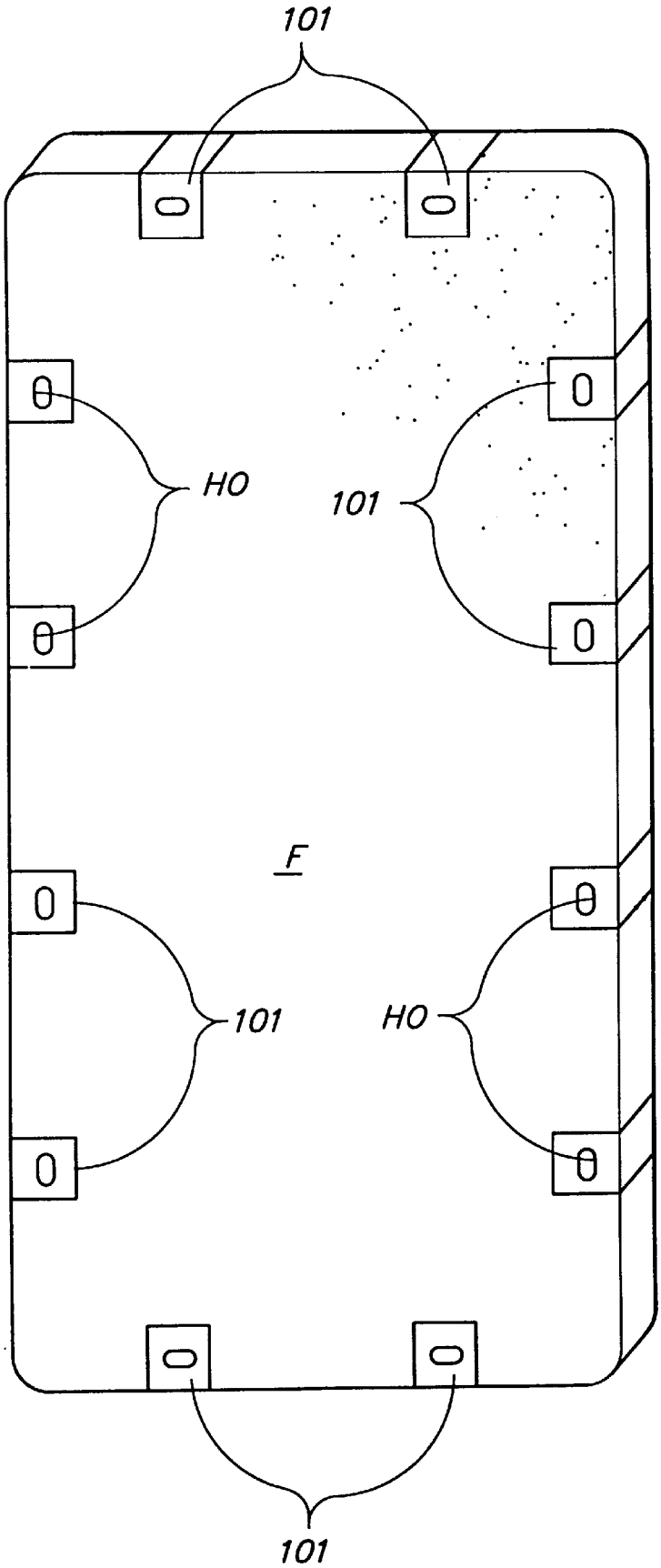
FIG. 25 is a perspective view of a float with reinforced connection ports or holes, according to the invention.
Figure 26:
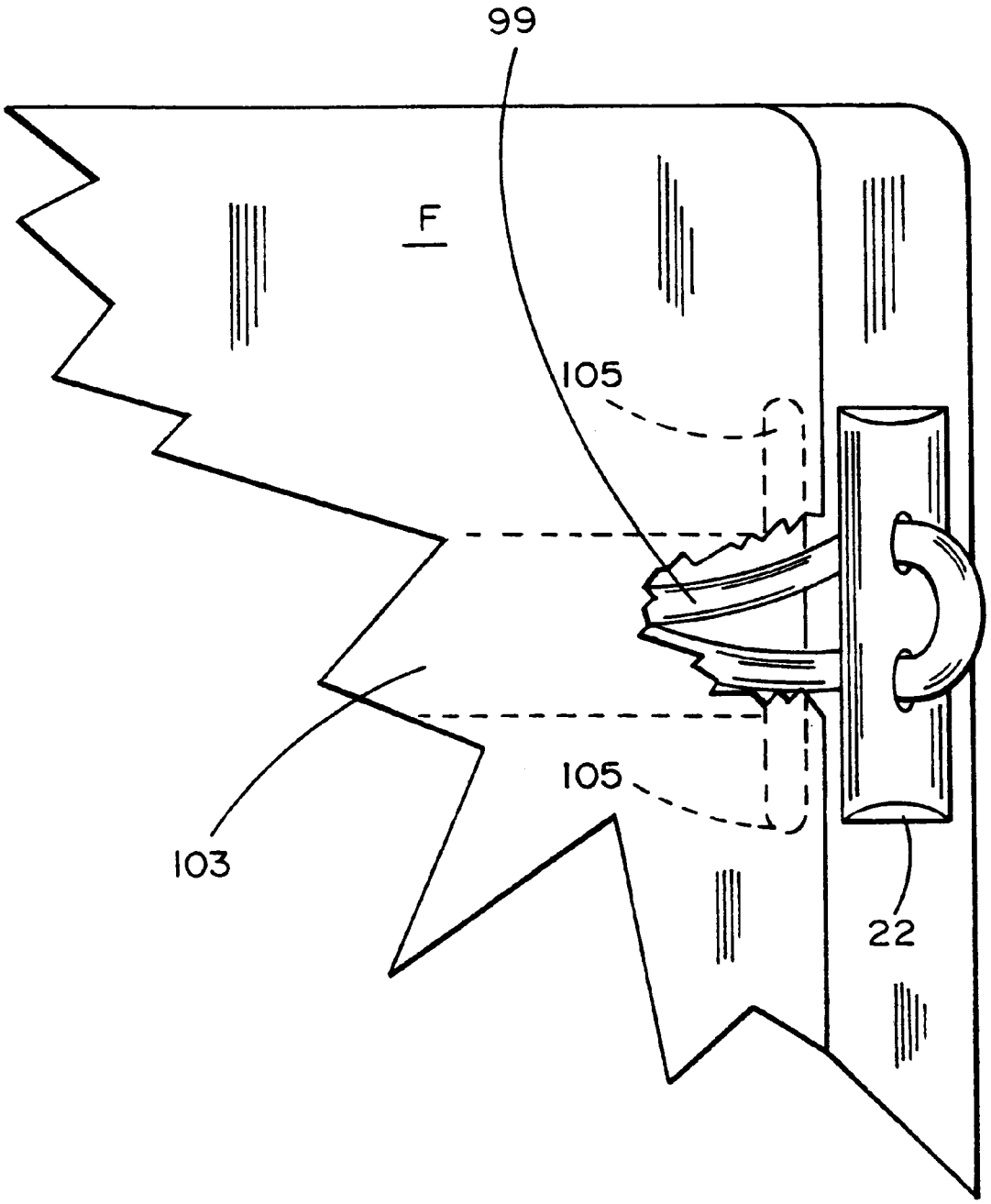
FIG. 26 is a partial cutaway view of a reinforcement structure for any one of the several connectors of the invention.

Given that some stress is likely to be placed on such holes HO, the float may include an interior peripheral reinforcement edge R, indicated in FIG. 23, made of a suitable material, e.g., nylon, or webbing material, a non-woven material, or sheet plastic, just to name a few examples. The reinforcement R could be applied to the exterior periphery of the float F, on one or both sides. As an alternative, the float may include reinforcement swatches 101, as seen in FIG. 25. Swatches 101 may be made of a suitable fabric, e.g., nylon, or webbing material, a non-woven material, or sheet plastic, again just to name a few possibilities. Another type of reinforcement is shown in FIG. 26. Here, a reinforcement tube 103 with flanged or lipped ends 105 is located internally of the float F. Interconnector 97 includes an elongated endless loop 99, long enough so that the dowels and a portion of loop 99 on each side may function as hermaphroditic connectors as explained earlier. Furthermore, this construction allows a non-stress resting place for the unused dowel 22, when the float F is suspended for drying and/or storage.

Figure 28:
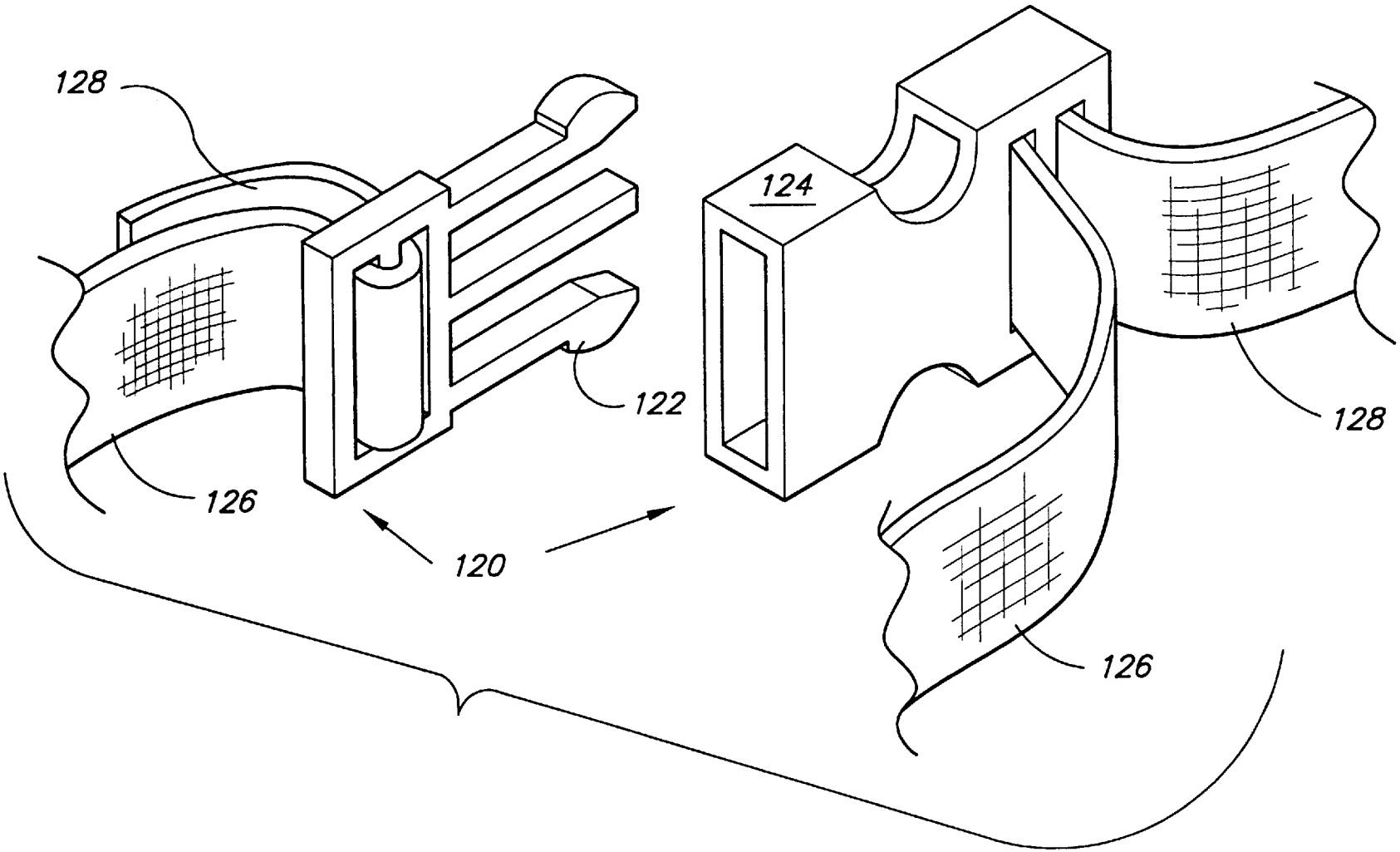
FIG. 28 is an enlarged scale perspective view of an otherwise conventional dual ladder-lock, side-release clip, useful with the instant invention.

Turning now to FIG. 28, yet a further connector assembly useful with the instant invention is shown, this being an otherwise conventional dual ladder-lock, side-release clip 120, with a male half 122 which inserts into female element 124. Slots for webbing halves 126 are usually provided, each ending in tails 128. Finger recesses 130 are provided on opposed sides of female element 124 so that the latch may be opened by depressing the opposed spring-loaded legs of male element 122 together and separating the parts.

Figure 31:
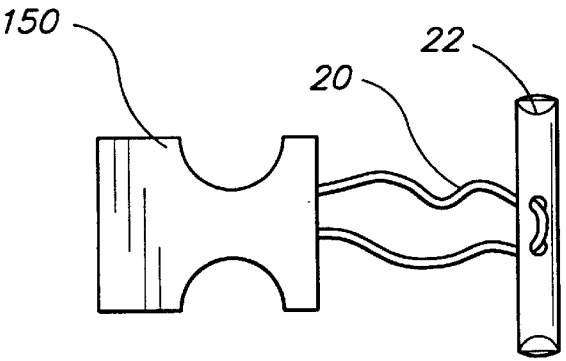
FIG. 31 is an elevational view of a combined connector, including a dowel connector of the instant invention combined with either a male or female half of the type of connector shown in FIG. 28.

A real nuisance can be mating male with female connector halves in the environment of water toys and devices, in particular. Often, mating connectors are simply not located at the desired locations. Solutions are provided by the connectors illustrated in FIGS. 29 and 30. A single interconnector structure 132 is shown in FIG. 29, with a female ladder-lock half 134 at one end, and a male ladder-lock half 136 at the other. Slots 138 for appropriate webbing or the like are provided centrally of connector 132. Thus, floats and other items can be provided with identical interconnectors and attached together at precisely the point desired without having to bother with whether or not a male or a female connector half is at the desired location. In FIG. 30, a piece of webbing 140 includes a first end 142 with a female ladder-lock connector 144, and an extra webbing piece 146 with a male ladder-lock connector 148; obviously, the locations of the connectors 144, 148 could be reversed. The alliance of the male half 122 and the female half 124 of the side-release clip 120 in FIGS. 29 and 30 shows, by example, that combining the two opposed ends of a connection device, either as one piece or two pieces separately attached, formulate a hermaphroditic connector. Now, a wide variety of hermaphroditic connectors may be employed as the connector of the floating devices connection and storage system, and are within the teachings of the present invention. In FIG. 31, the dowel 22 and cord 20 represent a hermaphroditic connector, described above, which is combined with one of a female 150 (or male) ladder-lock representing a non-hermaphroditic connector. This allows any non-hermaphroditic connector (e.g., ladder-lock connector, Velcro, etc.) to be converted into hermaphroditic connectors or vice versa without any modification at all of the remaining structure. Thus, the adapters of the invention allow simple conversion from one interconnection system to another interconnection system. Stated another way, this allows any ladder-lock type connector ends, male or female, to be converted into hermaphroditic connectors without any modification of the remaining structure at all.

Figure 32:
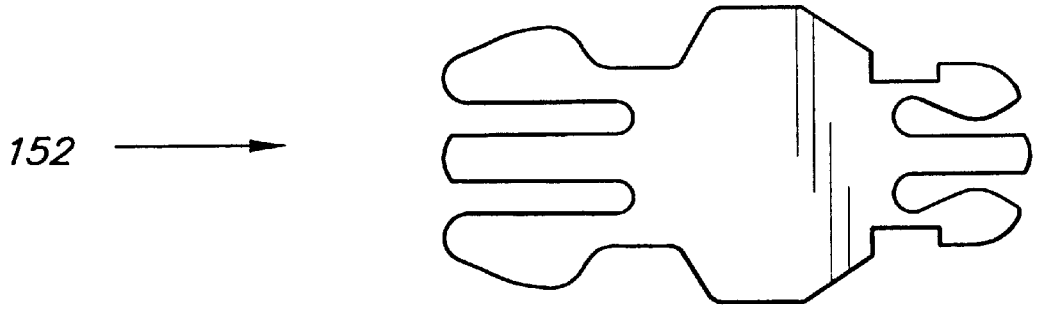
FIG. 32 is an elevational view of a double ended, female adapter useful in interconnecting two different sized (e.g., 1" to 1½") male halves of an otherwise conventional dual ladder-lock, side-release clip, useful as a part of the instant invention.
Figure 33:
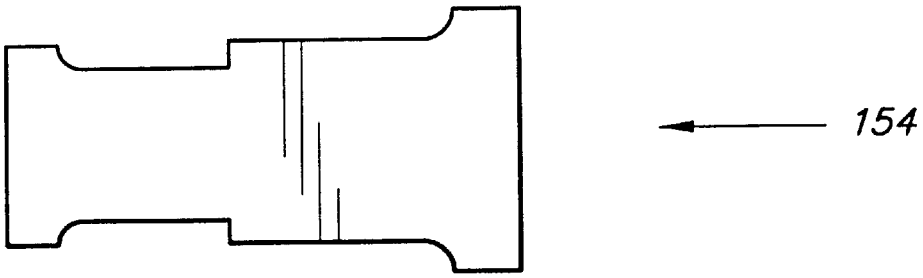
FIG. 33 is an elevational view similar to FIG. 32, but illustrating a double ended male connector.

Turning now to FIGS. 32 and 33, it can become necessary to convert differently sized ladder-lock connectors to a more useful size. FIGS. 32 and 33 disclose adapters for this purpose, a male adapter 152 in FIG. 32, and a female adapter 154 in FIG. 33. These can be used, for example, to step down a 1½" connector to a 1" connector, and vice versa.

Figure 34:
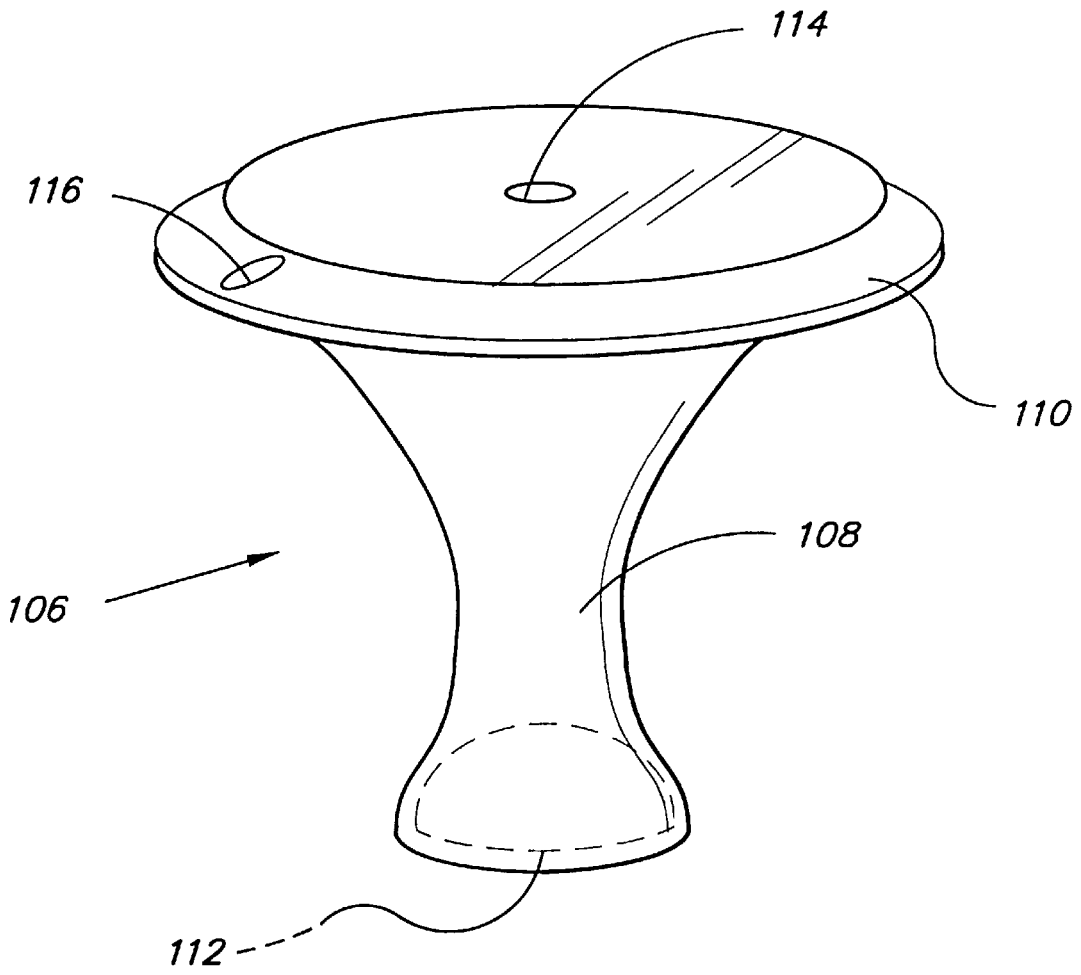
FIG. 34 is a perspective of a weighted, floating or poolside table made in accordance with teachings of this invention.

Another feature of the instant invention is shown in FIGS. 34–37, these illustrating a novel weighted and floatable, in water and out of water table, generally indicated at 106 in FIG. 34, for example. The table includes an attractive, gently upwardly tapered pedestal 108 supporting a table top 110. A weight may be provided in the lower part of the pedestal 108, as indicated at 112. The weight is dimensioned and engineered such that the table is stable and less likely to turn over in both water and at water side. The table is dimensioned and engineered such that the table will float in water with the table top elevated above the water surface; for example, the specific gravity of the overall table may be slightly less than 1. The center of the table may include a drainage hole 114 (which might also be used to support an umbrella—as shown in FIG. 1) which may go all the way through the bottom of the table, or be angled to end in a drain hole 116 at the side of the table top 110

Figure 35:
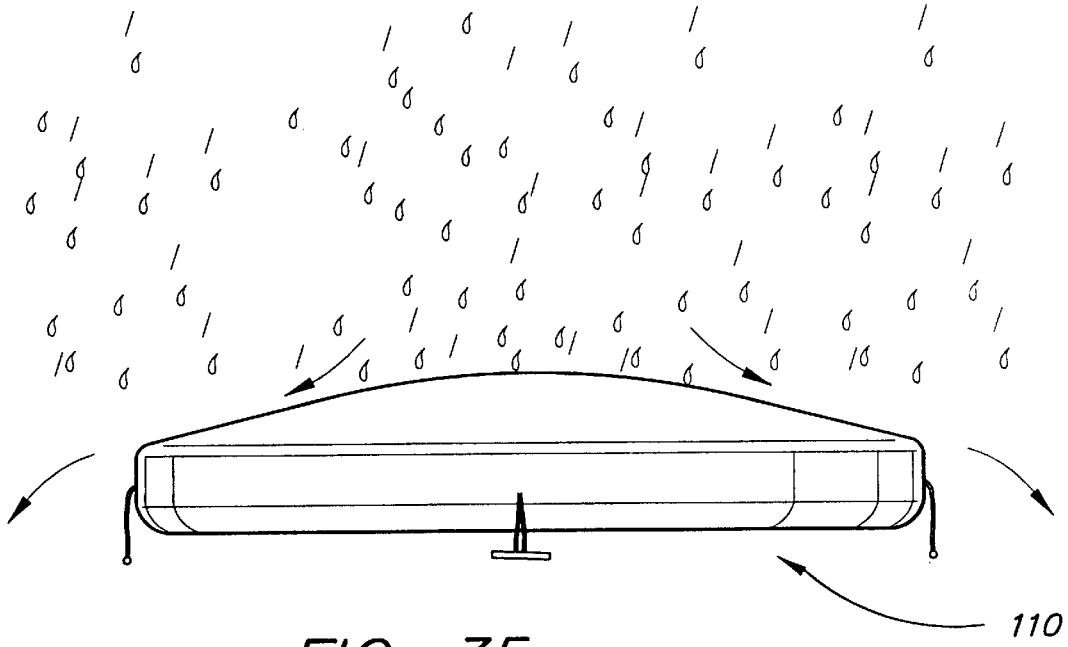
FIG. 35 is a side elevational view of the table of FIG. 31, with the upper surface thereof shown in exaggerated fashion to reveal the self-draining construction of the table, and further showing connection devices according to the invention attached to the periphery of the table.
Figure 37:
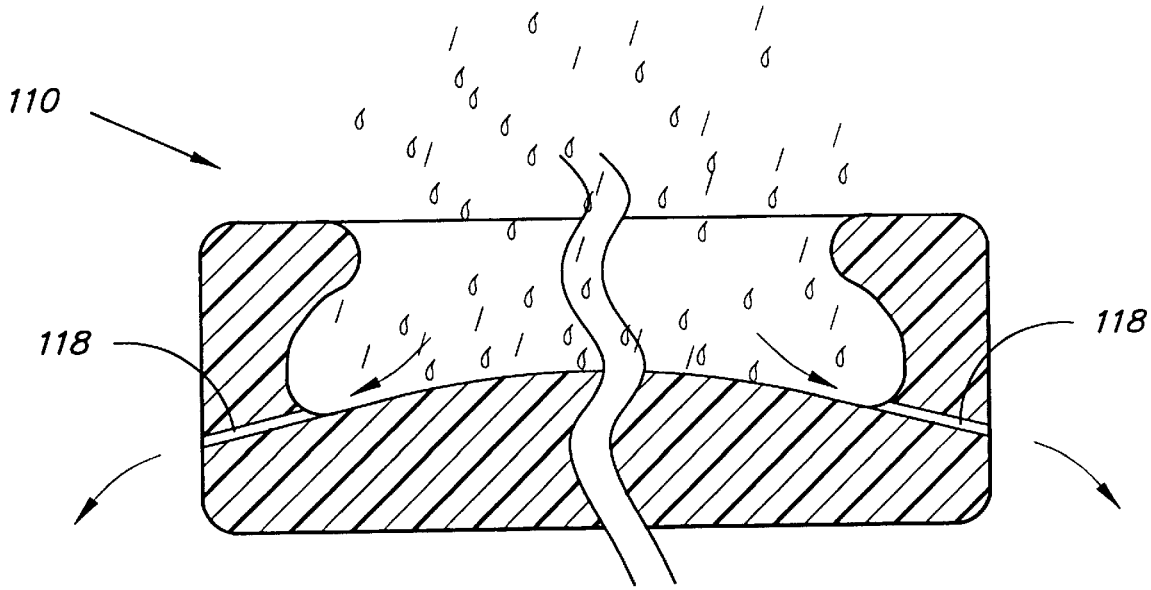
FIG. 37 is a cross-sectional view of another embodiment of the table of FIG. 31, interior parts thereof being shown in exaggerated fashion to reveal the self-draining construction thereof.

Alternatively, and as shown in the exaggerated view of FIG. 35, table top 110 may be convex in configuration so that water simply flows down and off the table surface. Or, and as shown in the exaggerated view of FIG. 37, the table top may be recessed and a number of peripherally spaced drain holes are provided, two of which are shown at 118, 118.

The periphery of table top 110 may include a plurality of connectors (connector 18, for example) discussed above, for use while in water, so that the table can stay attached to a pad, floating device, and/or extension connector, etc., without drifting away. As an example, four connectors 18 may be provided, spaced 90 degrees apart from one another. Also, and as previously described, the attached connectors are useful for securing the table to a storage structure or rack. For example, a storage structure could be mounted on the ceiling of a structure and suspend the table, via the connectors, overhead for short or long term storage.

Figure 36:
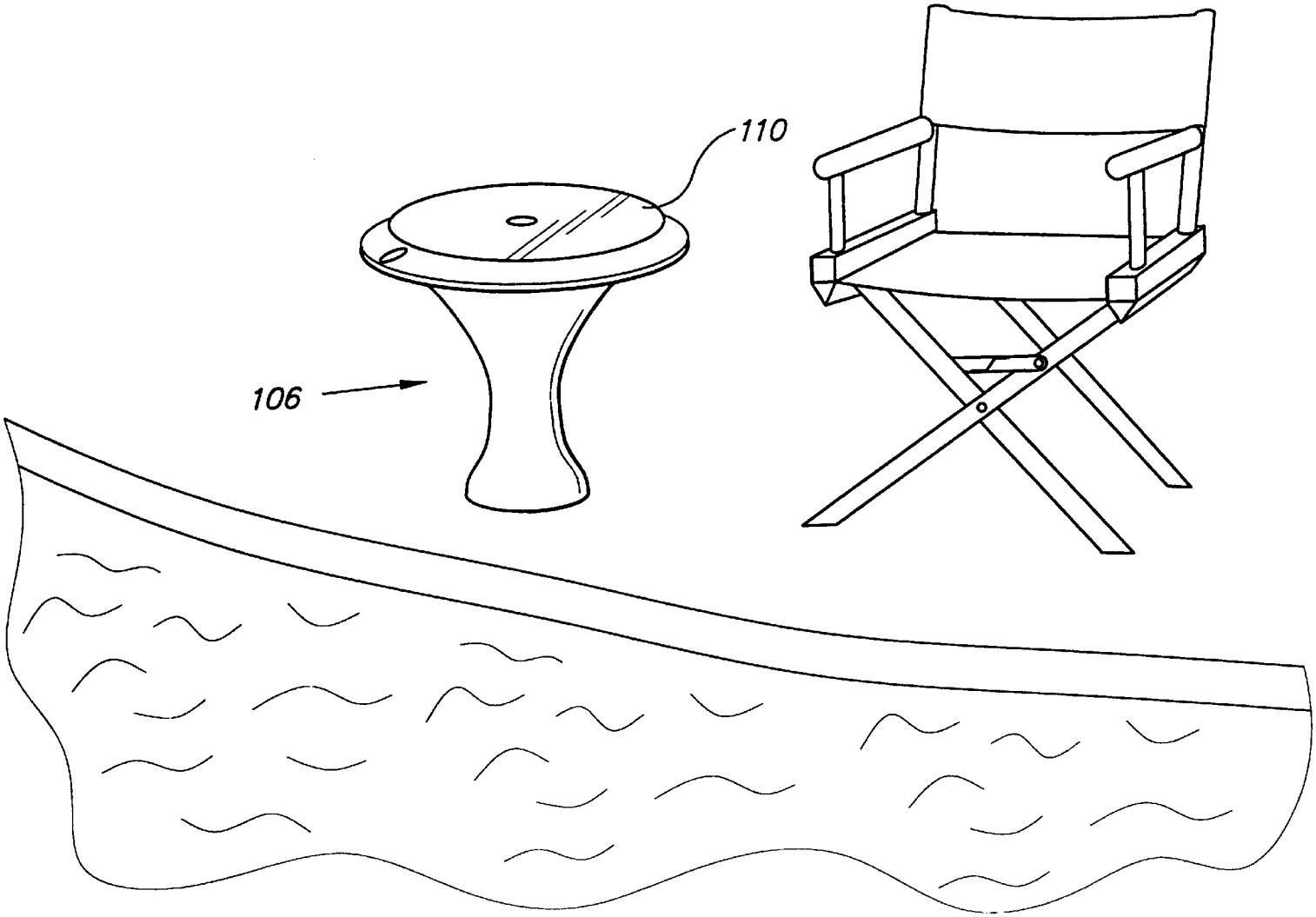
FIG. 36 is an environmental, perspective view of the table of FIG. 31, shown being used out of water in a poolside setting.

FIG. 36 shows, for example, one proper scale for the table 106, and its use out of water, at poolside or any shore side, for example. The weight in the base of the table further assures its stability when used out of water. The table top 110 may include cutouts which provide a stable resting place for items placed on the table top 110 when in use, for example, a cooler, a drink, etc.

Figure 38:
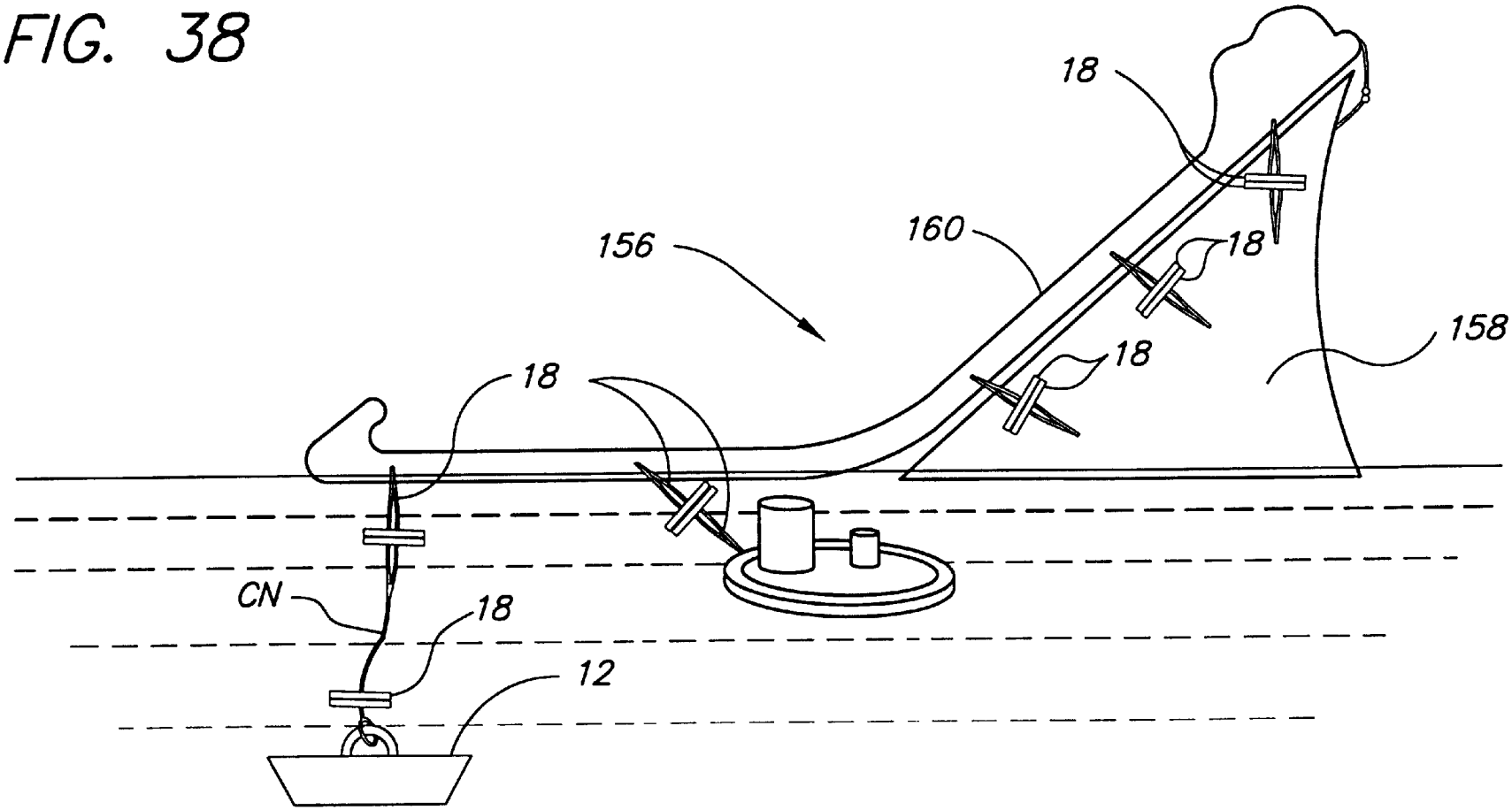
FIG. 38 is an elevational, environmental perspective view of a floating lounge made according to the principles of the instant invention, there being a floating wedge attached by connectors to a float to form the lounge; an anchor and table are also shown connected to the floating lounge.

In FIG. 38, we disclose a novel water lounge 156, which may employ the connectors of the instant invention to form the lounge. A floating wedge 158 forms a lounge out of a float 160, by being positioned and secured as shown by connectors, such as the connectors 18 disclosed above. An anchor weight 12 may be provided and connected as shown, to keep the lounge 156 from drifting annoyingly, and a small table is also shown at 162, similarly connected to lounge 156.

By now, it will be appreciated that a floating devices connection and storage system with a very wide variety of hermaphroditic and non-hermaphroditic connectors for interconnecting two or more floating devices together has been taught. The connectors may be original equipment or added as after-market items. Storage devices store floating devices, water toys and accessories (floating or non-floating, e.g., weights) preferably spaced from a vertical surface, to guard against mold and mildew formation on the floating devices by assuring air flow about the stored device. A floating table having a weighted base and a water-draining top surface is taught, for in water or out of water use, without need of any modifications whatever to transfer from one use to another and back again.

It is to be understood that the present invention is not limited to the embodiments described above, but encompasses any and all embodiments within the scope of the following claims.

We claim:

1. A floating devices connection and/or storage system, comprising:

a floating device having a peripheral edge;

a predetermined number of connection devices arrayed about said floating device peripheral edge, each said connection device being hermaphroditic in construction;

means for assuring secure interconnection of a selected connection device with another, similar connection device; and means for storing said floating device, comprising a plurality of suspension means on a vertical surface interconnected with said connection devices, and spacing means for separating said floating device from the vertical surface, thus assuring air flow about substantially the entire floating device and thus reducing the possibility of mildew and/or mold formation on said floating device during storage.

2. The floating devices connection and/or storage system as claimed in claim 1, wherein said connection devices and said suspension means are identical.

3. The floating devices connection and/or storage system as claimed in claim 1, wherein said spacing means comprise a pair of vertically arranged board means, said suspension means being affixed to said board means.

4. Means for storing and suspending a floating device from a vertical surfaces comprising:

an extending length body of cord material having opposed ends;

means for removably attaching said body to the vertical surface;

friction-fit sliding means for stabilizing said cord material ends in suspension assembly; and spacer means for separating the floating device from the vertical surface.

5. The means for storing and suspending a floating device from a vertical surface as claimed in claim 4, further comprising:

movable floating device engagement means for securing the floating device to said cord body, without damaging the floating device.

6. The means for storing and suspending a floating device from a vertical surface as claimed in claim 4, said cord body being configured as a length of cord, doubled back upon itself to provide a first loop at one said end.

7. The means for storing and suspending a floating device from a vertical surface as claimed in claim 4, further comprising:

suspension loop means at both ends of said cord body.

8. A floating table structure for use in water, the water having a surface, the floating table structure comprising:

a table top; and a weighted pedestal attached to the table top, the weighted pedestal extending vertically from the table top, wherein the weighted pedestal orients the table top above the weighted pedestal when the floating table structure is floating;

wherein the weighted pedestal and the table top have a buoyancy, such that the weighted pedestal and the table top float and the table top remains above the surface of the water during floating.

9. The floating table structure of claim 8, wherein the table top and weighted pedestal are of unitary construction, such that the table structure is usable while floating in the water and when placed on a generally flat surface, the weighted pedestal including a base having a generally flat underside so as to provide a stable support when the floating table structure is placed on the generally flat surface.

10. The floating table structure of claim 8, wherein the table top has an upper surface, the upper surface being sufficiently convex in configuration so as to cause water thereon to run off the edges of the table top.

11. A floating device storage system, comprising:

a floating device having a peripheral edge, the floating device having a plurality of floating device connectors arrayed about the peripheral edge, wherein each of the plurality of floating device connectors is hermaphroditic and connectable with at least one other similar connector; and a storing device, the storing device including:

a plurality of suspension connectors on a vertical surface, each of the plurality of suspension connectors being connectable with at least one of the plurality of floating device connectors; and at least one separator for separating the connected floating device from the vertical surface, the at least one separator assuring air flow substantially about the connected floating device.

12. The floating device storage system of claim 11, wherein the at least one separator reduces the likelihood of mildew formation on the connected floating device.

13. The floating device storage system of claim 11, wherein the at least one separator reduces the likelihood of mold formation on the connected floating device.

14. The floating device storage system of claim 11, wherein at least one of the plurality of suspension connectors is identical to at least one of the plurality of floating device connectors.

15. The floating device storage system of claim 11, wherein the at least one separator comprises a vertically arranged support, and wherein at least one of the plurality of suspension connectors is affixed to the vertically arranged support.

16. The floating device storage system of claim 15 wherein the vertically arranged support comprises a board.

17. A floatation device connection and storage system, comprising:

at least one floatation device having a peripheral edge;

at least one floatation device connector attached to the at least one first floatation device; and a storage device, the storage device including:

a storage device body;

at least on suspension connector attached to the storage device body, the at least one suspension connector being connectable with the at least one floatation device connector, such that the at least one floatation device is suspended by the storage device; and at least one separator for separating the at least one floatation device from the storage device body.

18. A storing device for storing and suspending at least one floating device via a vertical surface, the storing device comprising:

a flexible extension having a first end and a second end, the flexible extension being attachable to the vertical surface;

a suspension assembly having frictionally adjustable connectors for adjustably stabilizing each of the flexible extension ends; and a spacer for separating the at least one floating device from the vertical surface.

19. The storage device of claim 18, wherein the flexible extension comprises a length of cord.

20. The storage device of claim 18, further comprising:

at least one movable floating device engagement coupler for securing the at least one floating device to the flexible extension without damaging the floating device.

21. The storage device of claim 18, wherein the flexible extension is doubled back upon itself to provide a first loop at the first end.

22. The storage device of claim 18, further comprising:

at least one suspension loop holder for suspendably holding the first and second ends of the flexible extension.

23. A floating device storage system, comprising:

a floating device having a peripheral edge, the floating device having a floating device connector at the peripheral edge, wherein the floating device connector is hermaphroditic and connectable with at least one other similar connector; and a storing device, the storing device including:

a suspension connector on a vertical surface, the suspension connector being connectable with the floating device connector; and at least one separator for separating the connected floating device from the vertical surface, the at least one separator assuring air flow substantially about the connected floating device.

24. The floating device storage system of claim 23, wherein the separator reduces the likelihood of mildew formation on the connected floating device.

25. The floating device storage system of claim 23, wherein the separator reduces the likelihood of mold formation on the connected floating device.

26. The floating device storage system of claim 23, wherein the suspension connector is identical to the floating device connector.

27. The floating device storage system of claim 23, wherein the separator comprises a vertically arranged support, and wherein the suspension connector is affixed to the vertically arranged support.

28. The floating device storage system of claim 27, wherein the vertically arranged support comprises a board.

* * * * *